US008540530B2

(12) United States Patent
Ohnishi et al.

(10) Patent No.: US 8,540,530 B2
(45) Date of Patent: Sep. 24, 2013

(54) CONNECTING STRUCTURE AND PRODUCTION METHOD

(75) Inventors: Teruyuki Ohnishi, Atsugi (JP); Shinichi Isobe, Ebina (JP); Kohtaro Shiino, Isehara (JP); Toru Takahashi, Hiratsuka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 7 days.

(21) Appl. No.: 13/283,027

(22) Filed: Oct. 27, 2011

(65) Prior Publication Data

US 2012/0149243 A1 Jun. 14, 2012

(30) Foreign Application Priority Data

Dec. 8, 2010 (JP) ..... 2010-273253

(51) Int. Cl.
*H01R 9/05* (2006.01)

(52) U.S. Cl.
USPC ..... 439/581

(58) Field of Classification Search
USPC ..... 439/581, 579, 279, 604, 660, 606, 439/497, 499, 552, 445
See application file for complete search history.

(56) References Cited

U.S. PATENT DOCUMENTS

| | | | | |
|---|---|---|---|---|
| 4,605,276 | A * | 8/1986 | Hasircoglu | 439/465 |
| 4,781,620 | A * | 11/1988 | Tengler et al. | 439/497 |
| 5,387,124 | A * | 2/1995 | Shinohara et al. | 439/497 |
| 5,967,838 | A * | 10/1999 | Wozniczka et al. | 439/552 |
| 5,993,256 | A * | 11/1999 | Shimojyo | 439/604 |
| 6,478,624 | B2 * | 11/2002 | Ramey et al. | 439/607.1 |
| 6,648,676 | B1 * | 11/2003 | Lee | 439/499 |
| 6,733,300 | B2 * | 5/2004 | Oguma | 439/15 |
| 6,783,389 | B1 * | 8/2004 | Lee | 439/489 |
| 6,910,914 | B1 * | 6/2005 | Spink, Jr. | 439/497 |
| 7,744,395 | B1 * | 6/2010 | Cantolino | 439/279 |
| 7,909,659 | B2 * | 3/2011 | Cheng | 439/680 |
| 7,959,464 | B2 | 6/2011 | Mizutani et al. | |
| 8,167,650 | B2 * | 5/2012 | Gagne | 439/606 |
| 8,262,411 | B2 * | 9/2012 | Kondo | 439/607.01 |
| 8,272,891 | B2 * | 9/2012 | Kataoka et al. | 439/540.1 |
| 8,333,616 | B2 * | 12/2012 | Su et al. | 439/660 |
| 8,337,243 | B2 * | 12/2012 | Elkhatib et al. | 439/581 |
| 2010/0075535 | A1 | 3/2010 | Mizutani et al. | |

FOREIGN PATENT DOCUMENTS

| | | |
|---|---|---|
| JP | 07-326424 A | 12/1995 |
| JP | 2008-269858 A | 11/2008 |
| JP | 2009-286173 A | 12/2009 |

* cited by examiner

*Primary Examiner* — Alexander Gilman
(74) *Attorney, Agent, or Firm* — Foley & Lardner LLP

(57) ABSTRACT

A connecting structure to connect electronic components electrically through a plurality of conducting lines each including a covered segment including a wire conductor covered with an insulating covering and an uncovered segment includes a molding unit and a sealing unit. The molding unit encloses a boundary portion between the covered segment and the uncovered segment of each of the conducting lines so that the uncovered segments project in a first direction from a first end of the molding unit and the covered segments project in a second direction from a second end of the molding unit, and thereby holding the conducting lines to fix positions of the conducting lines relative to one another. The sealing member of an adhesive adheres to the second end of the molding unit and adheres to each of the covered segments of the conducting lines projecting from the second end of the molding unit.

6 Claims, 11 Drawing Sheets

CONNECTING STRUCTURE AND PRODUCTION METHOD

BACKGROUND OF THE INVENTION

The present invention relates to a connecting structure including a connector, and a method of producing the connecting structure.

JP2009-286173A shows a connector (terminal structure) for connecting electronic components electrically. This connector is provided in an electric power steering device and arranged to open to the outside for connection with a cable for conducting electricity.

SUMMARY OF THE INVENTION

It is an object of the present invention to provide a connecting structure, and/or production method for producing a connecting structure, adequate for simplifying the structure of a connector.

According to one aspect of the invention, the connecting structure comprises a molding member enclosing a boundary portion between a covered segment and an uncovered segment of each of conducting lines.

According to another aspect of the present, a production method for forming a connecting structure to connect electronic components electrically, the production method comprises a molding step of filling a first resin material into a first mold and thereby forming a molding member of the first resin material enclosing a boundary portion between a covered segment and an uncovered segment of each of conducting lines.

BRIEF DESCRIPTION OF THE DRAWINGS

FIG. 2 shows a partial section of the connector (1).

DETAILED DESCRIPTION OF THE INVENTION

The following is explanation on embodiments implementing the connector and its production method, with reference to the drawings.

First Embodiment

Figure 1:
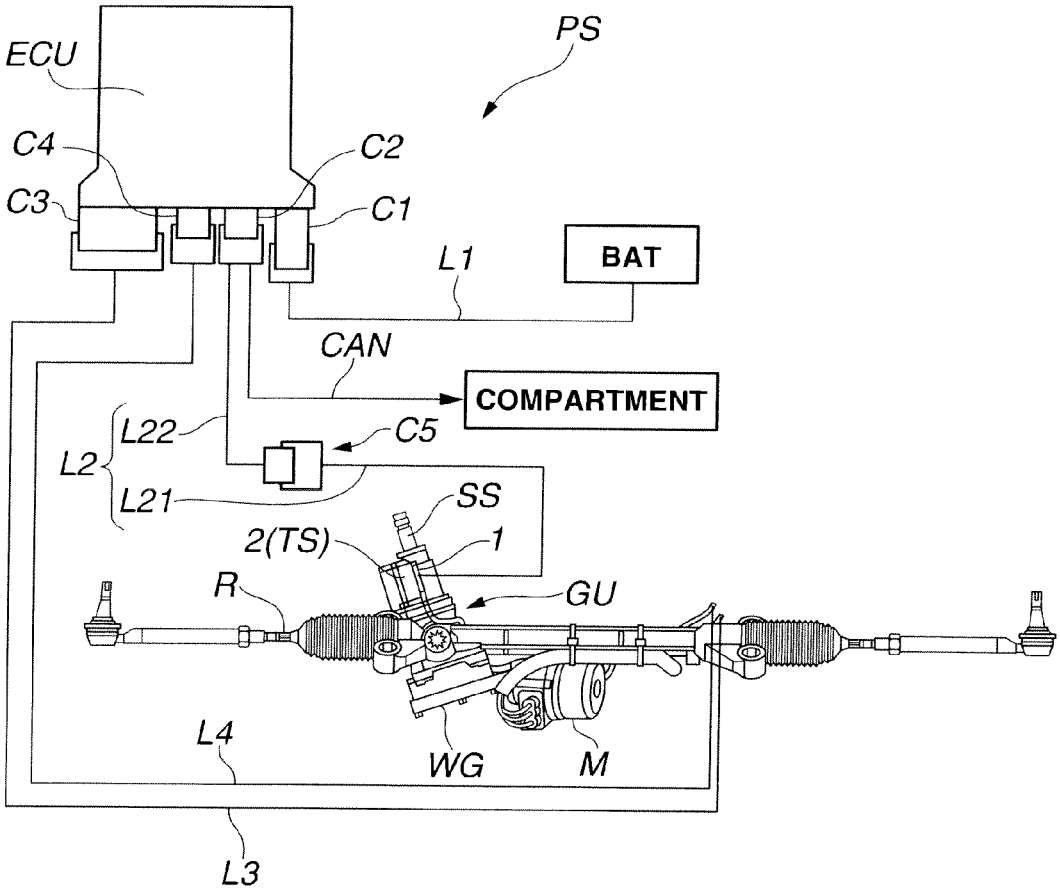
FIG. 1 is a schematic view showing an electric power steering system in which a connector (1) according to a first embodiment of the present invention is provided.

[Construction] A connector 1 according to a first embodiment is designed to be provided in an electric power steering apparatus (hereinafter referred to as PS system) for a motor vehicle, though the present invention is applicable to connectors and production methods for various apparatuses other than the PS system, including an apparatus not for a vehicle. FIG. 1 shows the PS system in which the connector 1 is provided. The PS system of FIG. 1 includes a gear unit GU (power steering gear assembly) as an actuator, and a control unit ECU as a controlling means or controller. The connector 1 is provided in gear unit GU and arranged to connect the inside and the outside of gear unit GU electrically.

Gear unit GU includes an electric motor M, a speed reduction mechanism including a worm gear WG, and a torque sensor TS serving as steering torque sensing means. A driving force of motor M is transmitted through worm gear WG to a rack R, to impart a steering assist force to steerable wheels of the vehicle. The output shaft of motor M is provided with a resolver serving as a motor rotational position sensing means. Torque sensor TS senses a driver's steering torque inputted to a steering wheel, in the form of a torsion of a steering shaft SS. The torque sensor TS as a first electronic component is enclosed in a torque sensor housing 2 having a shape similar to a rectangular parallelepiped attached to steering shaft SS. The control unit ECU as a second electronic component is provided with a plurality of connectors C1~C4 (male portions of the connectors). The connectors C1~C4 are connected, respectively, with cables L1~L4 (female portions of the connectors). With the connectors C1~C4 and cables L1~L4, the control unit ECU is connected electrically with a plurality of devices.

Connector C1 is a source connector connected through power line L1 with a power source BAT. Control unit ECU receives the supply of electric power thorough power line L1 from power source BAT. Connector C2 is a signal connector connected with a device in a passenger compartment through a CAN communication line, and further connected with torque sensor TS through a signal line L2. The CAN communication line is a bidirectional communication line for transmitting a signal (such as an on/off signal of an ignition key) from the passenger compartment to control unit ECU, and transmitting a signal from control unit ECU to the to passenger compartment. Signal line L2 transmits a torque signal produced by torque sensor TS to control unit ECU. Signal line L2 includes signal lines L21 and L22 which are connected with each other by a connector C5.

Connector C3 is a source connector connected through a power line L3 with motor M. Power line L3 supplies driving power from control unit ECU to motor M. Connector C4 is a signal connector connected with the resolver through a signal line L4. Signal line L4 transmits a motor rotational position signal produced by the resolver to control unit ECU. Each of connectors C1~C5 has a structure of a known type and includes two sockets (male portion and female portion) which can be fit together for connection. Control unit ECU calculates a desired target assist force in accordance with the sensed steering toque and/or other input information, and controls the motor M by producing a motor drive signal to drive motor M in accordance with the target steering assist force and an input signal such as an input signal of the motor rotation position.

Figure 2:
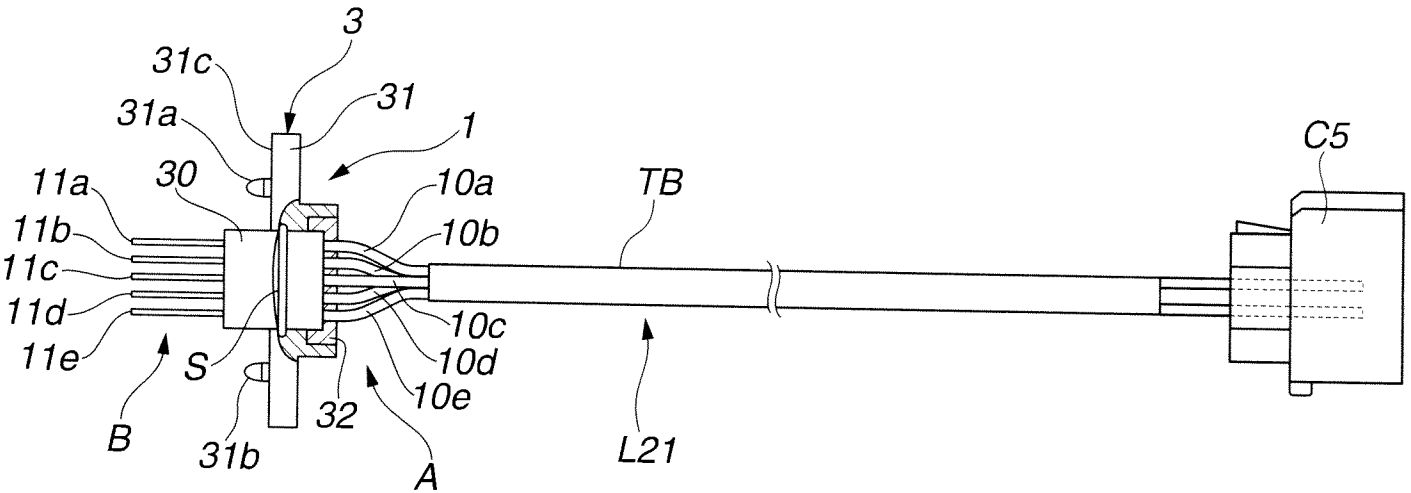
FIG. 2 is a plan view of a signal line L21 shown in FIG. 1.

FIG. 2 is a plan view of the signal line L21, and shows a partial section of the connector 1. Signal line L21 includes a first end (right end in FIG. 2) provided with connector C5 (female portion of connector C5) for connection with control unit ECU (through signal line L22), and a second end (left end) provided with connector 1 for connection to torque sensor TS. As shown in FIG. 2, the connector 1 is thinner (in the longitudinal direction of signal line L21) than connector C5. A dimension of connector 1 in the direction in which the signal line L21 extends is smaller than a dimension of connector C5. Signal line L21 is a harness including therein a plurality of covered wires. In this example, this harness includes five covered wires 10*a*, 10*b*, 10*c*, 10*d* and 10*e*. The number of the covered wires is not limited to five, and the number can be determined freely according to the need. Each covered wire 10 includes a conductive wire or wire conductor covered with an insulating covering (or insulating covering layer). In this example, the insulating material of the covering layer is polyethylene material such as flame resistant polyethylene formed by adding flame retardant to polyethylene. The signal line L21 is formed by putting these covered wires 10*a*~10*e* together in an insulating tube TB. In the second (left) end portion of signal L21 near connector 1, the covered wires 10*a*~10*e* are not covered by tube TB, but bared so that the covered wires 10*a*~10*e* can be ramified.

Figure 6:
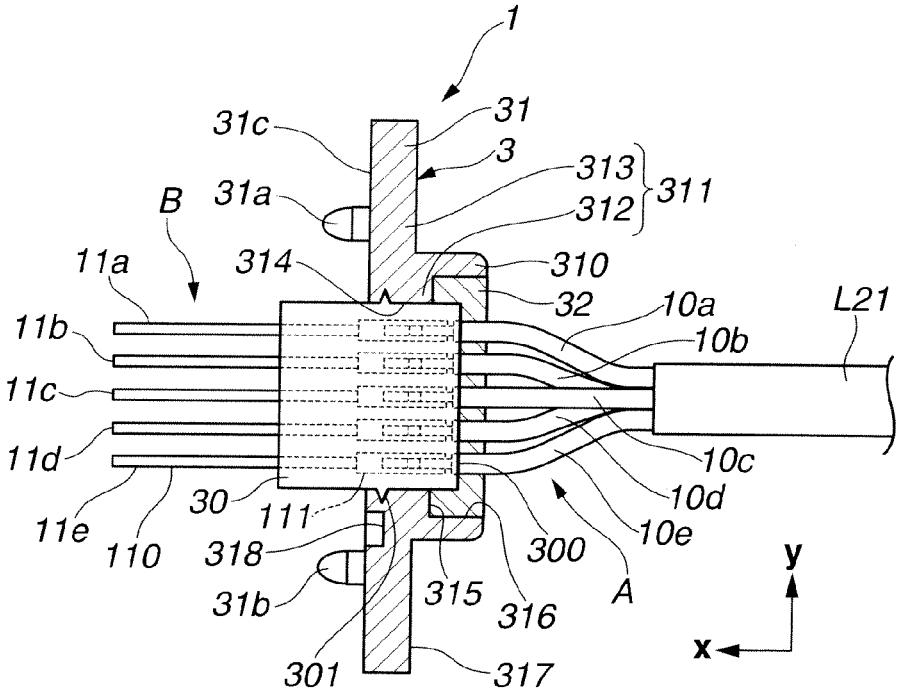
FIG. 6 is a partial sectional view of the connector 1 (across a line I-I in FIG. 7).

Each of the covered wires 10*a*~10*e* extends to a forward end portion which includes a covered portion A in which the wire conductor is covered with the insulating covering and an uncovered portion B in which the wire conductor is not covered by the insulating covering in an uncovered region (cf. FIG. 6). The uncovered portion of each covered wire 10*a*~10*e* is connected with a conductive member (terminal) or lead conductor 11*a*, 11*b*, 11*c*, 11*d* or 11*e* not covered with insulator. Conductive members 11*a*~11*e* project from a first (left) side of connector 1 in a first (leftward) direction whereas the covered portions (A) of covered wires 10*a*~10*e* project from a second (right) side of connector 1 in a second (rightward) direction opposite to the first direction.

Accordingly, each of covered wires 10*a*~10*e* is connected with a corresponding one of conductive members (lead conductors) 11*a*~11*e* so as to form a single continuous conducting line including a forward (left) end portion including a covered segment A in which the wire conductor is covered with the insulating covering, and an uncovered or bared segment B in which the conductor formed by the wire conductor and lead conductor (11) is not covered by the insulating covering. Connector 1 (a molding unit 3, as mentioned later) includes an abutment surface 31*c* on the uncovered (first) side of connector 1 (left side as viewed in FIG. 2), and a plurality of pins 31*a*, 31*b* serving as an engaging portion. The abutment surface 31*c* is a flat surface which is substantially flat, and faces in the first (leftward) direction in which the conductive members 11*a*~11*e* of the uncovered segments B project. The pins 31*a*, 31*b* project from the abutment surface 31*c* in the first (leftward) direction in which the conductive members 11*a*~11*e* project. In this example, there are provided two of the pins 31*a* and 31*b*. Each of the pins 31*a* and 31*b* is a locate pin having a tapered tip end.

Figure 3:
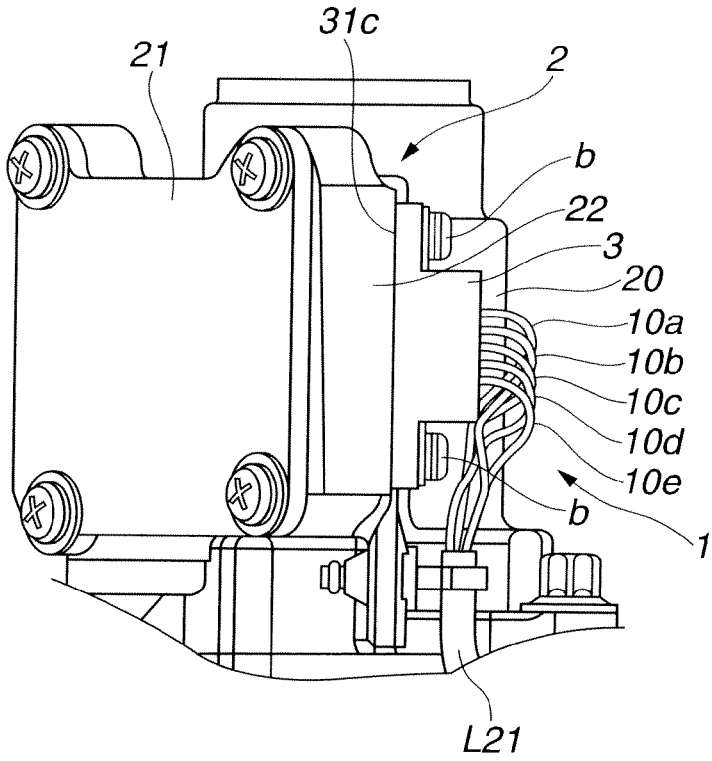
FIG. 3 is a perspective view showing a connecting portion between a torque sensor housing 2 (of torque sensor TS) and the connector 1, as viewed in a direction perpendicular to an axial direction of steering shaft SS (an arrow direction δ shown in FIG. 4).
Figure 4:
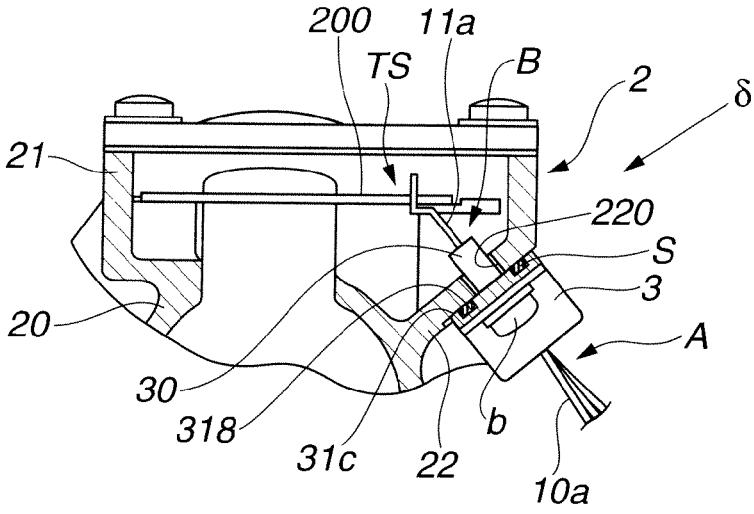
FIG. 4 is a top view of the connecting portion between the torque sensor housing 2 and the connector 1, as viewed in the axial direction of steering shaft SS.

FIG. 3 and FIG. 4 show a connecting portion between the torque sensor housing 2 (of torque sensor TS) and the connector 1. FIG. 3 shows the connecting portion as viewed in a direction perpendicular to an axial direction of steering shaft SS (an arrow direction δ shown in FIG. 4). FIG. 4 is a top view of the connecting portion as viewed in the axial direction of steering shaft SS. FIG. 4 shows a partial section of torque sensor housing 2 cut by a plane perpendicular to the axial direction of steering shaft SS, and a partial section of connector 1. Torque sensor housing 2 (hereinafter referred to as housing 2) is made of metallic material such as aluminum type metallic material, and includes a shaft receiving portion 20 shaped like a hollow cylinder and arranged to receive steering shaft SS (torsion bar) and a substrate receiving portion 21 shaped like a rectangular parallelepiped and arranged to receive a substrate 200. The substrate 200 is formed with a control circuit to control the impedance of torque sensor TS. Housing 2 further includes a connector mount portion 22 in the form of a flat plane extending in the radial direction of steering shaft SS. The connector mount portion 22 is formed in a connecting portion between the shaft receiving portion 20 and substrate receiving portion 21.

The connector mount portion 22 is formed with a through hole 220 opened through from the inside to the outside of housing 2, and arranged to receive the connector 1 (first molding member 30 as a wire receiving portion of connector 1) so that the connector 1 is inserted through the through hole 220. Moreover, connector mount portion 22 is formed with engagement holes (depressions) to engage with pins 31*a* and 31*b* of connector 1, and bolt holes each to receive a bolt b screwed into the bolt hole to join the connector 1 to housing 2. A groove 318 is formed in the abutment surface 31*c* on an x positive side. The groove 318 is an annular groove surrounding the through hole 220. The annular groove 318 is a seal groove to receive an O ring S as a seal member.

The abutment surface 31*c* of connector 1 is adapted to abut on the connector mount portion 22 (in the manner of a face to face contact) when connector 1 is connected with housing 2. The pins 31*a* and 31*b* of connector 1 are fit in the engagement holes in the connector mount portion 22, respectively, so that connector 1 is engaged with connector mount portion 22 (housing 2). Moreover, the connector 1 is fastened to connector mount portion 22 (of housing 2) by a plurality of bolts b (two of the bolts b in the illustrated example). As shown in FIG. 4, in the state in which the connector 1 is installed in housing 2, a plurality of uncovered segments B project from the wire receiving portion (first molding member 30) in housing 2. Each of these uncovered segment B is bent and connected, as a connecting terminal, with the substrate 200 installed in substrate receiving portion 21. The dimension of first molding member 30 projecting from abutment surface 31*c* may be greater than the thickness of housing 2 (connector mount portion 22) or may be smaller than the thickness of housing 2 (connector mount portion 22).

Figure 5:
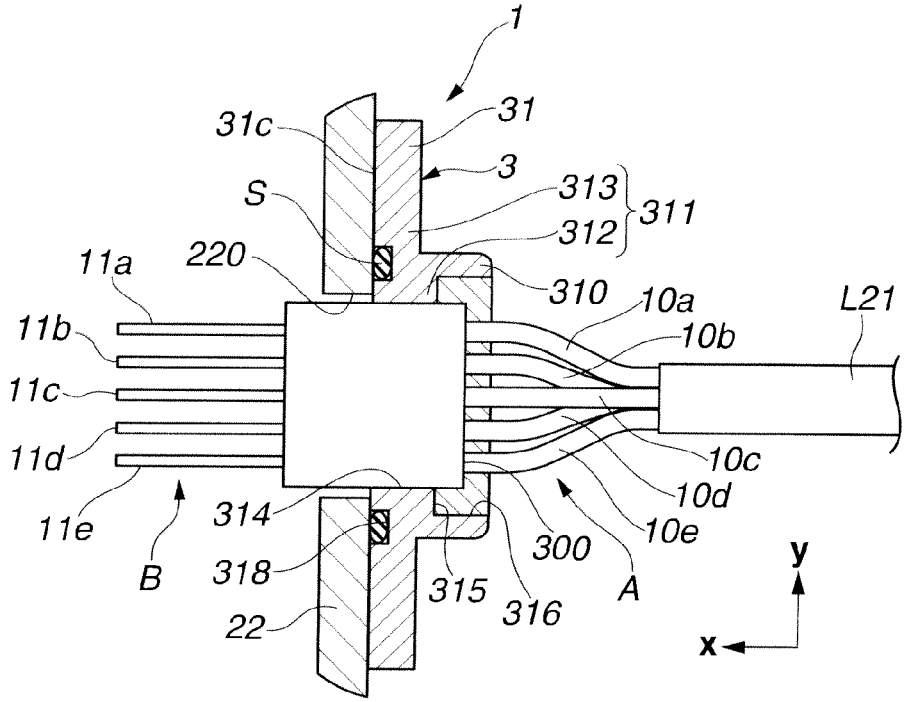
FIG. 5 is a view showing a partial section of the connecting portion of the connector 1, cut by a flat plane parallel to the axial direction of the steering shaft.
Figure 7:
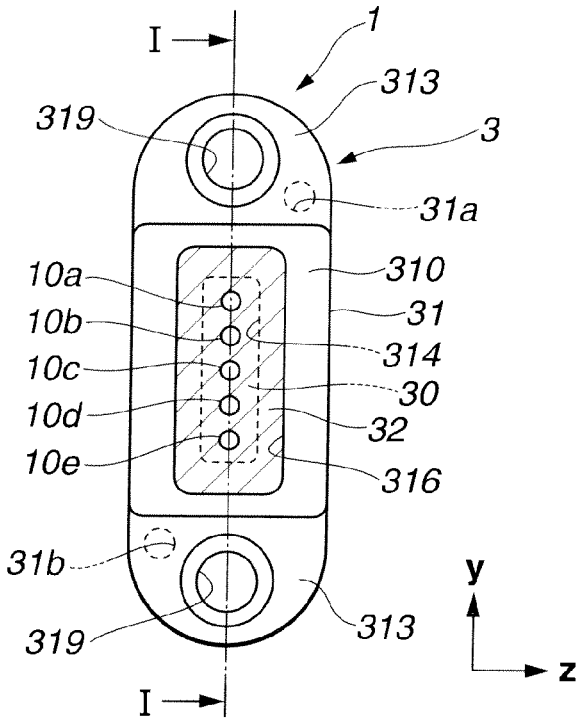
FIG. 7 is a front view of the connector 1 as viewed from the x axis negative side or from the signal line L21 side.

FIG. 5 shows a partial section of the connecting portion of connector 1, cut by a flat plane parallel to the axial direction of the steering shaft SS. In FIG. 5, the engaging portion (31*a* and 31*b*) and bolts b are omitted for simplicity. The following explanation uses an orthogonal coordinate system. An x axis extends in the direction in which signal line L21 extends (the longitudinal direction of covered wires 10). An x axis positive direction (or x positive direction) extends from a main portion of signal line L21 (the covered region A) to a forward end (the uncovered region B). A y axis extends in a direction in which the covered wires 10*a*~10*e* are arranged, as shown in FIG. 5. A y axis positive direction (or y positive direction) extends from the position of covered wire 10*e* toward the position of covered wire 10*a*. A z axis is perpendicular to an x-y plane. A z axis positive direction (z positive direction) is a direction from the upper (front) side of the paper of FIG. 5 to the lower (back) side. Like FIG. 5, FIG. 6 is a partial sectional view of the connector 1 (substantially corresponding to a sectional view taken across a line I-I in FIG. 7). FIG. 6 shows an internal structure by broken lines inside the connector 1 (first molding member 30). A bolt through hole 319 is omitted in the figure. FIG. 7 is a front view of the connector 1 as viewed from the x axis negative side (or x negative side).

Connector 1 includes a wiring section (covered wires 10*a*~10*e*, and the conductive members 11*a*~11*e*) and a holding section which, in this example, includes the molding unit 3. Molding unit 3 is a resin member including therein, and holding, (parts of) the covered segments A of covered wires 10*a*~10*e* and (parts of) the uncovered segments B. Molding unit 3 of this example is a molding assembly including a first molding member 30 and a second molding member 31 (holding member).

First molding member 30 is a wire receiving portion or wire gripping portion for receiving and enclosing a boundary portion between the uncovered segment B and the covered segment A of each covered wire 10. First molding member 30 is made of a first resin material. In this example, the first resin material is a resin material which does not adhere to the insulator. The first resin material may be a polyester resin superior in moldability (or formability), heat resistance, electric properties (insulating properties), and mechanical properties (rigidity). Preferably, the first resin material of first molding member 30 is PBT (polybutylene terephthalate) resin.

First molding member 30 has a shape like a rectangular parallelepiped which is approximately square when viewed from the z axis direction. The dimension in the z axis direction of first molding member 30 is smaller than the x axis dimension and smaller than the y axis dimension, so that the shape of first molding member 30 resembles a flattened rectangular parallelepiped. The covered wires 10*a*~10*e* are arranged at equal intervals in a line along the y axis at a middle in the z axis direction inside first molding member 30 (as best shown in FIG. 7). The covered wires 10*a*~10*e* extend straight in the x axis direction inside first molding member 30. The uncovered portion B of each of covered wires 10*a*~10*e* is connected with one of conductive members 11 (11*a*~11*e*) as the uncovered segment B. There are provided a plurality of the conductive members (lead conductors) 11*a*~11*e*. The number of conductive members 11*a*~11*e* is equal to the number of covered wires 10 (10*a*~10*e*). In this example, the number is five.

Each conductive member 11 is a conductor bared entirely without being covered with insulating material. Each conductive member 11 includes a main portion 110 extending like a line, and a base portion 111 provided at an axis negative side end of the main portion 110 and shaped to have a width in the y axis direction greater than the width of the main portion 110. The base portion 111 is longer, in the dimension in the x axis direction, than the uncovered portion B of each of the covered wire 10*a*~10*e*, and shorter, in the dimension in the x axis direction, than first molding member 30. The base portion 111 of each conductive member 11 and the uncovered portion B of a corresponding one of covered wires 10*a*~10*e* are buried and fixed in first molding member 30 in the state in which the base portion 111 and the uncovered portion B of the cover wire are overlapped as viewed from the z axis direction and contacted with each other (in this example, the uncovered portion B of the covered wire is received in the base portion 111 of the conductive member 11). First molding member 30 is formed by molding so that the uncovered segments B (main portions 110 of the conductive members 11) projects from one side (the x positive side or first side), and the covered segments A of covered wires 10*a*~10*e* project from the other side (the x negative side or second side). In other words, the uncovered portion B of each covered wire 10 is extended by connecting the connecting member 11, and the extended uncovered portion B projects in the x positive direction (first direction) from the x positive side end surface of the first molding member 30.

Second molding member 31 is made of a second resin material (which may be the same as the first resin material or may be different from the first resin material), and formed in the form of an integral unit with first molding member 30, to retain first molding member 30. As the second resin material of second molding member 3, it is possible to use the PBT (polybutylene terephthalate) resin like the first resin material. It is preferable to employ, as the second resin material, a resin having properties suitable to achieve later-mentioned operations and functions of the second resin material, and to improve the moldability. Second molding member 31 includes a wall portion 310 and a connecting portion or base portion 311. The wall portion 310 is a tubular portion or annular portion surrounding the covered segments A of covered wires 10*a*~10*e* on the x negative side (second side) of second molding member 31. Wall portion 310 surrounds the first molding member 30, has a shape like a rectangle as viewed from the x negative side, and extends in the x axis direction so as to form the shape of a rectangular column. Wall portion 310 includes two laterally extending segments extending in the y axis direction and spaced from each other in the z axis direction, and two normally extending segments extending in the z axis direction between the laterally extending segments so as to form a rectangular closed shape. The wall thickness of the laterally extending segments is greater than the wall thickness of the normally extending segments, as shown in FIG. 7. Wall portion 310 surrounds the first molding member 30 with a clearance (or annular space) surrounding the outside circumference of first molding member 30 entirely, and separating the outside circumference of first molding member 30 from wall portion 310 (in the y axis direction and the z axis direction). As shown in FIG. 6, the wall portion 310 of second molding member 31 projects in the x (axis) negative direction beyond an end surface 300 of first molding member 30 on the x (axis) negative side. The end surface 300 of first molding member 30 is a surface from which the covered segments A of covered wires 10*a*~10*e* project.

The connecting portion or base portion 311 of second molding member 31 is formed on the x positive side of wall portion 310 (the side on which the uncovered segments B are located with respect to the covered segments A of covered wires 10*a*~10*e*). Connecting portion 311 is designed to connect the wall portion 310 of second molding member 31 and the first molding member 30 liquid-tightly. Connecting portion 311 includes a main portion or central portion 312 and a flange portion 313. Main portion 312 has an outside circumference substantially identical to the outside circumference of wall portion 310 as viewed from the x axis direction. Main portion 312 includes an engagement hole 314 in which the first molding member 30 is fit, so that the connecting or base portion 311 fits over the first molding member 30. Engagement hole 314 extends in the x axis direction through second molding member 31.

Second molding member 31 (main portion 312) includes an end surface (or inner end surface) 315 on the x (axis) negative side. The end surface 315 is recessed in the x (axis) positive direction from the position of end surface 300 of first molding member 30. Accordingly, the end surface 300 of first molding member 30 projects in the x negative direction beyond the end surface 315 of second molding member 31. Second molding member 31 (main portion 312 and wall portion 310) forms an adhesive receiving portion for receiving an adhesive 32. The adhesive receiving portion is in the form of a depression 316 for retaining the adhesive 32 like a bathtub. The depression 316 as the adhesive receiving portion is defined by the end wall 315 of the main portion 312 on the x negative side (serving as a bottom of depression 316), the inside circumferential surface of wall portion 310 and the end surface 300 of first molding member 30 on the x negative side.

The connecting portion or base portion 311 of second molding member 31 of this example includes two of the connecting flange portions 313 projecting from the main portion 312, respectively, in the y positive direction and the y negative direction as shown in FIG. 7, at the end portion on the x axis positive side of the main portion 312. As shown in FIG. 7, each of flange portions 313 on the y positive and y negative sides has a semicircular shape as viewed in the x axis direction, and includes a bolt through hole 319 extending in the x axis direction through the flange portion 313, and a corresponding one of the pins 31*a* and 31*b* projecting from the surface (31*c*) on the x positive side, as shown in FIG. 6. Pin 31*a* is located on the z positive side of the bolt through hole 319. Pin 31*b* is located on the z negative side of the bolt through hole 319. In the illustrated example, the surfaces on the x positive side of flange portions 313 and the surface of the x positive side of main portion 312 are substantially flush with one another and form the abutment surface 31*c*. However, it is optional to employ the arrangement in which the surfaces on the x positive side of flange portions 313 and the surface of the x positive side of main portion 312 are not flush with one another.

The dimension of main portion 312 in the x axis direction is greater than the dimension of flange portions 313 in the x axis direction, so that the main portion 312 has a wall thickness in the x axis direction greater than the wall thickness of flange portions 313. The end surface 315 of main portion 312 on the x negative side is located on the x negative side of end surfaces 317 of flange portions 313 on the x negative side. The seal groove 318 is formed in the surface of connecting portion 311 on the x axis positive side (abutment surface 31*c*), and depressed to a predetermined depth in the x axis direction. The seal groove 318 surrounds the engagement hole 314, on the radial inner side of the pins 31*a* and 31*b*. The seal groove 318 is located at such position that seal groove 318 overlaps the wall portion 310 in the z axis direction (in which the wall portion 310 extends) (as viewed from the x axis direction). Similarly, the seal groove 318 is located at such position that seal groove 318 overlaps the wall portion 310 in the y axis direction (in which the wall portion 310 extends) (as viewed from the x axis direction).

Adhesive 32 forms a seal member provided in second molding member 31. Adhesive 32 is filled in depression 316 formed in second molding member 31. As adhesive 32, it is possible to use a flexible resin. In this example, flexible silicone resin is used as adhesive 32. The (inner) end surface 315 of main portion 312 of second molding member 31 on the x negative side and the end surface 300 of first molding member 30 on the x negative side are buried under the adhesive 32. The covered segments A of covered wires 10*a*~10*e* are buried under adhesive 32 to a predetermined depth. Adhesive 32 adheres to the end surface 300 of first molding member 30 on the x negative side and adheres to the outer circumferential surface of the insulating covering of the covered segment of each covered wire 10*a*~10*e*.

[Production Method]

Figure 8:
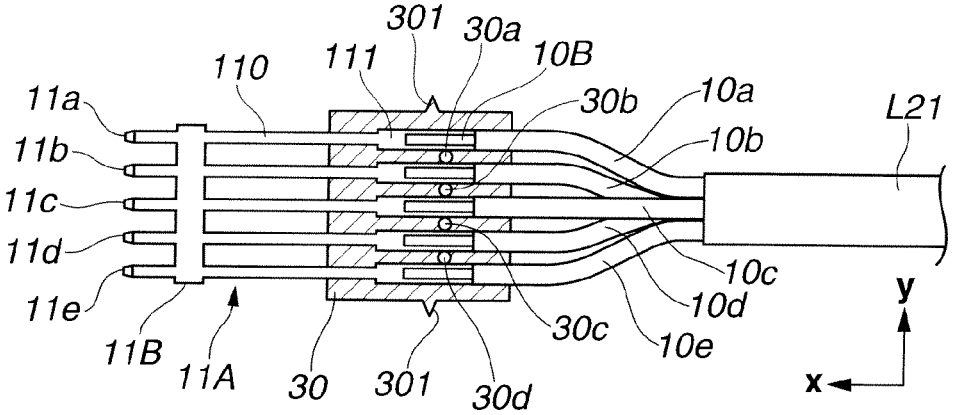
FIG. 8 is a partial sectional view showing a first molding member 30.
Figure 9:
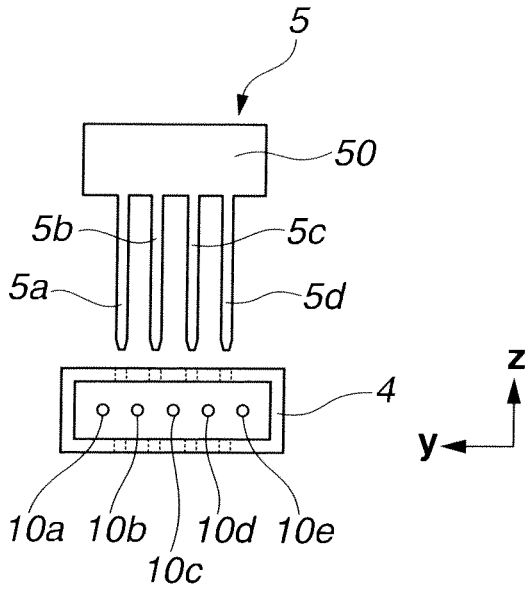
FIG. 9 is a front view of a first mold 4 (before a jig 5 is installed).
Figure 10:
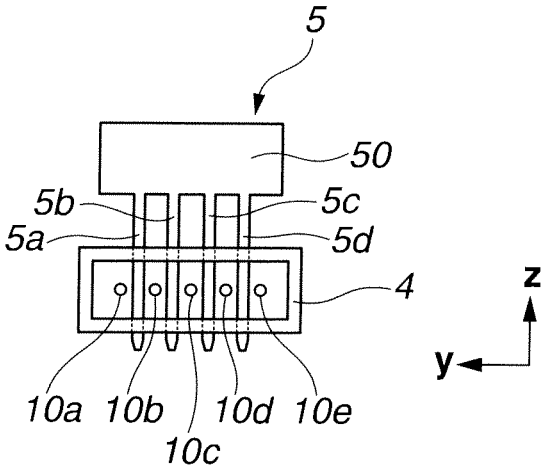
FIG. 10 is a front view of the first mold 4 (after the jig 5 is installed).
Figure 11:
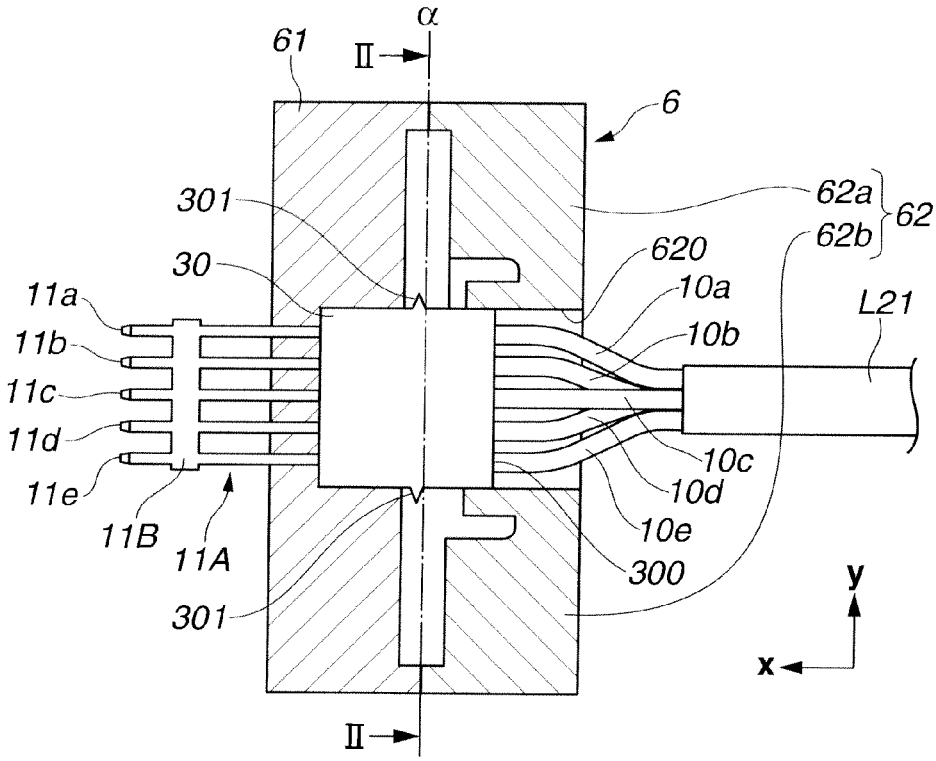
FIG. 11 is a partial sectional view showing a second mold 6 in the state in which the first molding member 30 is placed.
Figure 12:
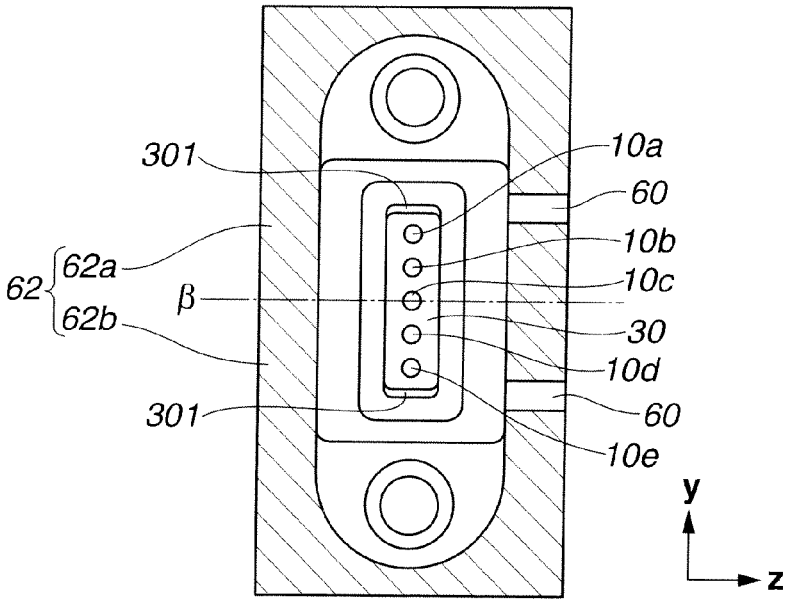
FIG. 12 is a front view of the second mold 6 in the state in which the first molding member 30 is placed (a cross section across a line II-II in FIG. 11).

A production method of producing the connector 1 includes at least first, second and third steps. FIG. 8 is a partial sectional view showing the first molding member 30 formed by molding in the first step, cut by a plane perpendicular to the z axis direction. FIGS. 9 and 10 are front views showing a first mold 4 as viewed from the x direction together with a jig used in the first step. FIG. 11 is a partial sectional view showing a second mold 6, cut by a plane perpendicular to the z direction, in the second step for forming the second molding member 31 by molding, in the state in which the first molding member 30 is positioned. FIG. 12 is a front view showing an x negative side portion 62 of the second mold 6 as viewed from the x positive side (corresponding to a cross section across a line II-II in FIG. 11). In FIG. 11, portions of the mold corresponding to pins 31*a* and 31*b* and through hole 319 are omitted.

The first step is a step (first molding step) of forming the first molding member 30 gripping or holding the covered wires 10*a*~10*e* (and conductive members 11*a*~11*e*) by using a first mold 4. The first step includes an operation of filling the first resin material of the first molding member 30, in the first mold 4, and an operation of releasing the molded product from the mold after coagulation, hardening or solidification of the first resin material. The first resin material becomes solid or hard after the molding operation and retains the solid or hard state to form the first molding member 30 and fix the positions of covered wires 10*a*~10*e* relative to each other, as explained more in detail below.

As shown in FIG. 8, the uncovered portion B of each covered wire 10*a*~10*e* is connected with one of the conductive members 11*a*~11*e* (so as to form the uncovered segment consisting of the uncovered portion of the covered wire and the conductive member). In the first step, the conductive members 11*a*~11*e* are connected together by a connecting portion or cross portion 11B extending laterally (in the y axis direction)(on the x positive side of the main portions 110) so that the conductive members 11*a*~11*e* are connected as a single unit (referred to as a connected conductive member 11A hereinafter). The uncovered portions 10B of covered wires 10*a*~10*e* are overlapped, respectively, with base portions 111 of the conductive members 11*a*~11*e* of the connected conductive member 11A. Then, the covered wires 10*a*~10*e* and connected conductive member 11A are placed in a first mold 4 in the state in which the overlapped portions (the base portion 111 and the covered portion 10B are contacted with each other for each of the covered wires 10*a*~10*e*) are included in the first mold 4. In this case, as shown in FIG. 9 and FIG. 10, each of pins 5*a*~5*d* of jig 5 is inserted between adjacent two of the covered wires 10*a*~10*e* (the uncovered portions 10B of covered wires 10*a*~10*e*). Jig 5 includes a holder portion 50 and a plurality of pins 5*a*~5*d* (four pins in the illustrated example) projecting integrally from holder portion 50. Jig 5 is a jig for positioning or determining positions of parts. As shown in FIG. 10, from the upper surface of first mold 4 (from the z positive side), the pins 5*a*~5*d* are inserted in the z direction into mold 4. Pins 5*a*~5*d* are positioned among conductive members 11*a*~11*e* of connected conductive member 11A (the base portions 111 of conductive members 11*a*~11*e*) so that one of pins 5*a*~5*d* is interposed between adjacent two of covered wires (the uncovered portions B of covered wires 10*a*~10*e*). Accordingly, the pins 5*a*~5*d* and (the uncovered portions B of) the covered wires 10*a*~10*e* are arranged alternately as shown in FIG. 10. Thus, the pins 5*a*~5*d* regulate or determine the relative positions of (uncovered portions B of) the covered wires 10*a*~10*e* relative to each other.

In this state, the first resin material is poured into first mold 4, and the first molding member 30 is formed by molding. Thereafter, jig 5 (with pins 5*a*~5*d*) are extracted. The first molding member 30 thus formed by removing pins 5*a*~5*d* includes a plurality of holes 30*a*~30*d* (four holes in this example), as shown in FIG. 8. The first molding member 30 formed by the first step holds firmly the conductive members 11*a*~1*e* connected, respectively, with the covered wires 10*a*~10*e* are connected together by the connecting portion 11B in the form of connected conductive member 11A. After the first step, the connecting portion 11B is cut and removed to separate and insulate the conductive members (connection terminals) 11*a*~11*e* from one another. As shown in FIG. 8, the first molding member 30 is formed by molding to have at least one rib or projection 301 at a predetermined position in a region surrounding by second molding member 31 (predetermined position in the x direction, see FIG. 11). In the illustrated example, the rib 301 has a triangular cross section as shown in FIG. 8, and includes a pointed top.

The second step is a step (second molding step) of forming the second molding member 31 firmly enclosing first molding member 30, by using a second mold 6. The second step includes an operation of filling the second resin material that is the material of second molding member 31, in the second mold 6 in the state in which first molding member 30 is placed in second mold 6, and an operation of demolding the second mold 6 after coagulation, hardening or solidification of the second resin material. After the second step, the second resin material retains the shape in the solid state, and thereby forms the second molding member 31 holding the first molding member 30 firmly. It is possible to form the pins 31*a* and 31*b*, bolt through holes 319 and seal groove 318 simultaneously, with the second mold 6. Alternatively, it is possible to form the pins 31*a* and 31*b*, bolt through holes 319 and seal groove 318 after the second step. Second molding member 31 is formed by insert molding. As shown in FIG. 11, second molding member 31 is molded by the insert molding process in the state in which the first molding member 30 (with covered wires 10*a*~10*e* and conductive members 11*a*~11*e*) is placed in the second mold 6.

As shown in FIG. 12, the second mold 6 includes gates 60 connecting the inside of the mold with the outside. In the illustrate example, two gates 60 are formed on the z positive side of second mold 6, one on the y positive side and the other on the y negative side. Gates 60 are holes used for pouring the high-temperature molten second resin into the second mold 6. In the state in which first molding member 30 is set in the second mold 6, the rib 301 is positioned adjacent to one of gates 60. In this example, the rib 301 is formed adjacent to each of gates 60. Rib 301 is positioned on an extension line of one of gates 60 (on the z negative side). The position in the x direction and the position in the y direction of each gate 60 are approximately overlapped with the position in the x direction and the position in the y direction of rib 301.

Figure 13:
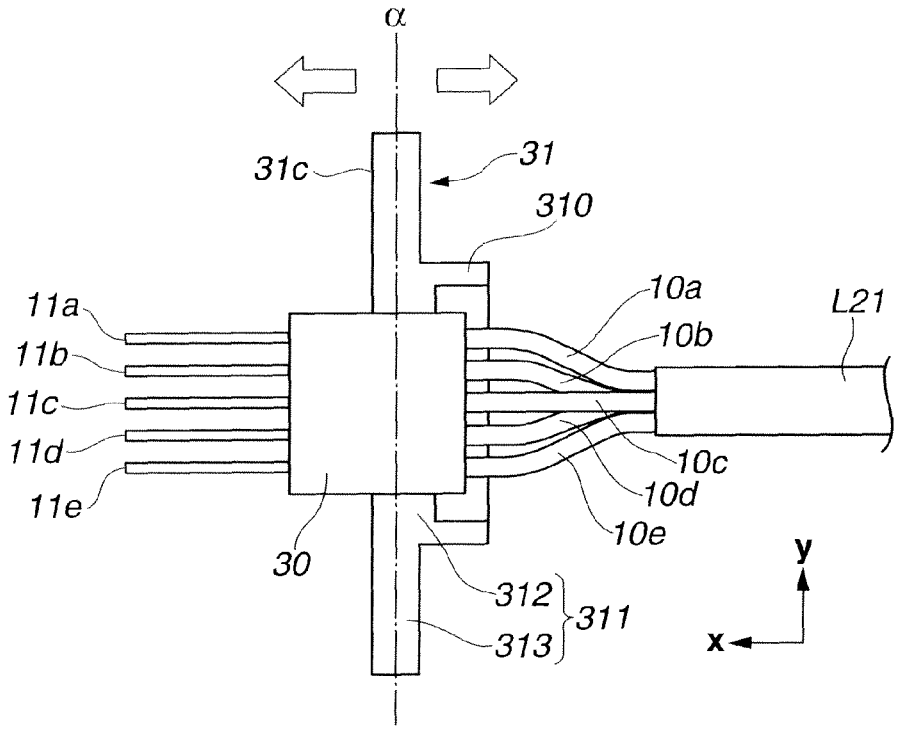
FIG. 13 is a view for showing a parting plane a of the second mold 6.

Second mold 6 includes a first part 61 on the x positive side and a second part 62 on the x negative side. After the formation of second molding member 31, the second mold 6 is divided into the two parts 61 and 62 on both sides of a parting plane α, as shown by arrows in FIG. 13. The parting plane α of second mold 6 is located on the x negative side of the abutment surface 31*c* of second molding member 31. Second molding member 31 is formed so that the parting plane α is positioned on the x negative side of abutment surface 31*c*. In this example, the parting plane α is located substantially at a middle of connection flange portion 313 in the x direction. After separation from the first part 61 on the x positive side, the second part 62 on the x negative side is divided into a first portion 62*a* on the y positive side and a second portion 62*b* on the y negative side on both sides of a parting plane β shown in FIG. 12.

The third step is a step of filling adhesive 32 in the second molding member 31 (in the depression 316 of second molding member 31). Adhesive 32 has a flowability at least at the time of filling adhesive 32 into second molding member 31 (depression 316). Adhesive 32 is filled to a position on the x negative side of the end (end surface 300) of first molding member 30 on the x negative side and is adhered to the outside circumference of the insulating covering of each of covered wires 10*a*~10*e*.

[Operations in the First Embodiment]

A connector (terminal structure) is used for connecting electronic devices electrically. The connector is connected with cables for connecting the electronic devices. In general, the cables are in the form of wires covered with an insulating material impermeable to water. Each of the covered wires (cables) has an uncovered portion or bared wire portion (connection terminal) in the connector, for electrical connection. The connector employs various waterproof structure to prevent water from reaching the uncovered portion and thereby to prevent corrosion. On the other hand, there are demand for simplifying the connector and restraining a size increase due to the waterproof structure. Accordingly, it is preferable to simplify the structure of the connector and maintaining the waterproof characteristic (sealing characteristic). One example is a resin connector attached integrally to an aluminum housing of an electric power steering of a type combining electronics and mechanics. In this connector, a cable (for signal line and power supply line) is connected through a hole opening to the outside. This connector has a fitting structure of two socket members (male portion and female portion) provided with waterproof structure. Therefore, it is difficult to reduce the size, and to improve the flexibility of layout of the electric power steering apparatus.

By contrast, the connector (terminal structure) 1 according to this embodiment, the first molding member 30 of waterproof material holds the covered wires 10*a*~10*e* firmly and the boundary portion between the covered segment and uncovered segment of each covered wire is buried in the first resin material of first molding member 30. The uncovered portions B of conductive members 11*a*~11*e* connected, respectively, with the uncovered portions B of covered wires 10*a*~10*e* project from a first side (x positive side) of first molding member 30, and the covered segments A project from a second side (x negative side) of first molding member 30 opposite to the first side. Therefore, it is possible to provide a reliable waterproof structure by setting the first side (the x positive side) of first molding member 30 in an electronic component (housing 2) and setting the second side in the outside of the electronic component (housing 2). This structure corresponds to the structure in which one socket is omitted from the structure including two sockets (female portion and male portion) fitted together and a sealing structure provided at either or both of the sockets. Accordingly, the structure of this embodiment is simple in the construction without the need for providing two of the sockets, so that it is possible to simplify the construction of the connector without sacrificing the sealing properties. Moreover, with the size reduction of connector 1, it is possible to improve the flexibility of layout of apparatus PS (gear unit GU) provided with the connector 1 in the vehicle. In the illustrated example, control unit ECU and gear unit GU are two separate units connected by lines such as signal line L2. However, it is optional to unite control unit ECU and gear unit GU into a single unit. In this case, it is possible to connect control unit ECU and torque sensor TS directly, and use the connector of this embodiment as a connector for connecting the control unit ECU with an external device. It is possible to employ the structure in which the covered segments A (the boundary portions between the covered segments and uncovered segments) are not included in first molding member 30. In this case, the boundary portions between the covered segments A and uncovered segments B are buried in the adhesive 32 to secure the waterproofness of the uncovered portions B.

First molding member 30 is made of a resin material. By employing the resin material superior in waterproof performance and properties for holding the covered wires 10*a*~10*e* firmly, it is possible to enhance the above-mentioned effects. However, the material of first molding member 30 is not limited to resins as long as the waterproof characteristic and the properties for holding covered wires 10*as*~10*e* are ensured sufficiently. The first molding member 30 of resin material formed by molding is effective for facilitating the production process. First molding member 30 in the solid or hard state after the molding operation can fix the positions of covered wires 10*a*~10*e* relative to one another. Therefore, it is possible to position the covered wires 10*a*~10*e* and conductive member 11*a*~11*e* readily without the need for means for positioning or regulating positions, and to simplify the construction of connector 1. As long as the positions are regulated to such an extent that the uncovered segments of covered wires 10*a*~10*e* (conductive members 11*a*~11*e*) are not contacted with one another, it is optional to use the first molding member 30 which does not become completely solid or hard after the molding operation. In this case, it is possible to employ a position regulating means for preventing contact.

First molding member 30 according to the first embodiment includes holes 30*a*~30*d* formed by pins 5*a*~5*d* of jig 5 for regulating the relative positions of covered wires 10*a*~10*e* only during the molding operation of first molding member 30. This feature can improve the relative position accuracy of covered wires 10*a*~10*e*, and prevent contact among the uncovered segments B of covered wires 10*a*~10*e* reliably. In this case, the uncovered segments B of covered wires 10*a*~10*e* and conductive members 11*a*~11*e* might be bared in the holes 30*a*~30*e* of first molding member 30. However, in this embodiment, second molding member 31 is formed around first molding member 30 and the holes 30*a*~30*d* are closed by second molding member 31. Therefore, this structure does not deteriorate the waterproof performance. In the illustrated example, the pins 5*a*~5*d* are inserted among the uncovered segments B of covered wires 10*a*~10*e*. However, it is possible to insert the pins 5*a*~5*d* among the covered segments A of covered wires 10*a*~10*e*. This structure can prevent the uncovered segments 10B from being bared in the holes 30*a*~30*d*, and restrain contact among the uncovered segments 10B more or less.

In the first step of the production method, the first molding member 30 is formed in the state in which conductive members 11*a*~11*e* are connected by connecting portion 11B as an integral member. This structure facilitates the positioning of conductive members 11*a*~11*e* relative to one another, and makes it possible to improve the relative position accuracy of conductive members (terminals) 11*a*~11*e* to facilitate the operation of connecting the connector 1 with a component (such as substrate 200) of an electronic component (torque sensor TS). The connecting portion 11B is cut off to separate and insulate the conductive members 11*a*~11*e* from one another after the first step. After the first step, the first molding member 30 is in the solid or hard state and the positions of conductive members 11*a*~11*e* are fixed by first molding member 30. By cutting the connecting portion 11B in this state, it is possible to secure the relative position accuracy among conductive members 11*a*~11*e*.

In this example, the first resin material of first molding member 30 is a resin which does not adhere to an insulating material. Therefore, the adhesion between the first molding member 30 and the first mold 4 is restrained in the first step. Therefore, a product (first molding member 30) can be removed readily from first mold 4, and the production efficiency is improved. When a resin material not adhesive to the insulating material is employed as the first resin material of first molding member 30, the adhesion of first molding member 30 with the insulating covering layers of covered wires 10*a*~10*e* is restrained. Therefore, when covered wires 10*a*~10*e* are subjected to forces bending or pulling the covered wires 10*a*~10*e* from the signal line L21 or subjected to a severe temperature condition, there may be formed clearances between the insulating coverings of covered wires 10*a*~10*e* and the first molding member 30 and hence these clearances require sealing to secure the waterproof performance. In the first embodiment, the clearances are covered or closed by adhesive 32 serving as sealant. Adhesive 32 is provided to seal the end portion of first molding member 30 (the end surface 300 in which these clearances open) from which the covered segments A of covered wires 10*a*~10*e* project in the x negative direction, and the outside circumferences of insulating coverings of covered segments A of covered wires 10*a*~10*e*. Adhesive 32 is filled to a predetermined thickness from the end surface 300 of first molding member 30, and adhesive 32 envelopes the outside circumference surface of the covered segment A of each covered wire 10*a*~10*e* contiguously. The covered segment A of each covered wire 10*a*~10*e* is buried in the adhesive 32. Therefore, the adhesive 32 prevents water from entering the region of uncovered is segments B from the clearances around the covered segments A of covered wires 10*a*~10*e*, and improves the waterproof performance. The material of first molding member 30 may be a material not adhesive to the first mold 4 to some degree to ensure the property to remove the produced molding member 30 from first mold 4. The material of first molding member 30 need not be a material strictly nonadherent to the insulating material. In other words, the material of first molding member 30 may have adherence of a certain degree. If the adherence is ensured between first molding member 30 and covered wires 10*a*~10*e*, it is possible to omit the adhesive 32 and the structure (such as the depression 316) for retaining adhesive 32. Furthermore, it is not necessary to fill the adhesive 32 entirely in the depression 316. The adhesive 32 is required to adhere to the end surface (surface 315) of first molding member 30 on the x negative side, and to adhere to the outside circumferences of insulating coverings of covered wires 10*a*~10*e* to prevent entry of water from the surrounding of each covered wire to the inside of first molding member 30 (including the uncovered segments B). Adhesive 32 may be applied only to one or more portions of the x negative side surface (300). It is possible to form one or more adhesive regions required for sealing the open end of the clearances in the end surface 300 without covering the end surface 300 entirely. In this case, too, the connecting structure of this embodiment can improve the above-mentioned effects.

As the material of adhesive 32, this example employs silicone resin which is high in adhesiveness to the insulating material of covered wires 10*a*~10*e*. Specifically, soft silicone resin (or flexible silicone resin) is used, and the sealing member formed by adhesive 32 is elastic. Therefore, the sealing member of adhesive 32 is pliable to a bending force, for example. The sealing member of adhesive 32 can be bent in conformity with a bending deformation of the covered segments A of covered wires 10*a*~10*e*. Therefore, the adhesive 32 lowers the possibility of generation of a clearance between adhesive 32 and covered wires 10*a*~10*e* (the insulating material), and improves the waterproofness. Instead of soft resin, it is optional to use, as adhesive 32, hard resin such as hard epoxy resin. In the case of the hard resin, the sealing member formed by the adhesive of the hard resin ensures the adherence to the covered wires 10*a*~10*e* like the soft resin, and improves the durability by providing a strong support structure with the rigidity of adhesive 32 for supporting the covered wires 10*a*~10*e* against load applied to the adhesive by bending motion and inclination of covered wires 10*a*~10*e*.

Materials usable in this embodiment have following values of the linear expansion coefficient. The linear expansion coefficient of soft silicone resin is 63×10-6, and the linear expansion coefficient of hard epoxy resin is 177×10-6. On the other hand, the linear expansion coefficient of PBT resin used as the materials of first and second molding members 30 and 31 is 75×10-6, and the linear expansion coefficient of fire retardant polyethylene of the insulating coverings of covered wires 10*a*~10*e* is 180×10-6. The soft silicone resin is closer in the linear expansion coefficient to PBT resin as compared with the hard epoxy resin. Therefore, the structure using the soft silicone resin as adhesive 32 can prevent detachment of adhesive 32 from first and second molding member 30 and 31 due to temperature changes, and improve the waterproofness by preventing generation of a clearance between adhesive 32 and first and second molding members 30 and 31 (depression 316). On the other hand, the materials usable in this embodiment have following values of strength (tensile strength). For example, the strength of soft silicone resin is 0.2 MPa, and the strength of hard epoxy resin is 82.7 MPa. On the other hand, the strength of PBT resin used as the materials of first and second molding members 30 and 31 is 118 MPa, and the strength of fire retardant polyethylene is 10 MPa. Thus, the soft silicone resin is lower in tensile strength than the fire retardant polyethylene whereas the hard epoxy resin is higher in tensile strength than the fire retardant polyethylene. Therefore, the structure using the hard epoxy resin as adhesive 32 can prevent breakage of the adhesive 32 against load applied to adhesive 32 by bending motion and inclination of covered wires 10*a*~10*e*, prevent generation of clearance (crack) inside the adhesive 32, and improve the durability and waterproofness. Therefore, from the viewpoint of prevention of clearance between adhesive 32 and the first and second molding members 30 and 31 due to temperature changes, prevention of crack in adhesive due to load, and improvement of waterproofness and durability, it is preferable to employ, as the adhesive 32, a material having a linear expansion coefficient close to that of the material or materials of first and second molding members 30 and 31 (for example, the linear expansion coefficient of adhesive 32 is about 75×10-6), and having a tensile strength equal to or greater than that of covered wires 10*a*~10*e* (insulating covering) (for example, the tensile strength of adhesive 32 is greater than or equal to 10 MPa).

Figure 14:
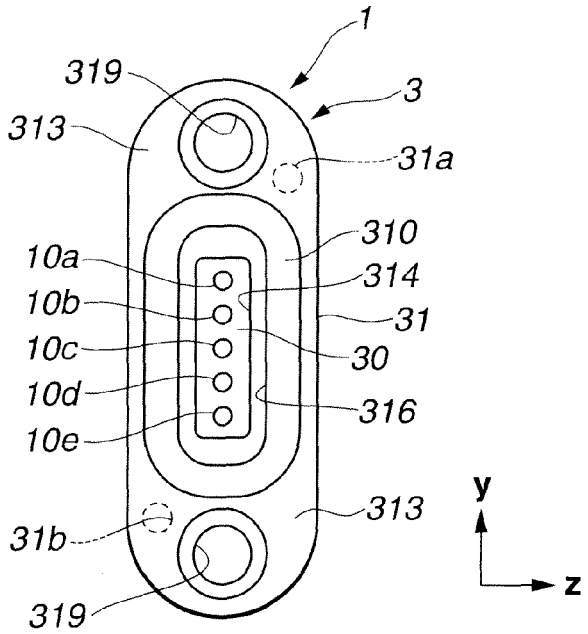
FIG. 14 is a front view showing the connector of a variation, as viewed from the x negative side or from the signal line L21 side.

First molding member 30 is provided with second molding member 31 serving as a receiving member or holding member for receiving the adhesive 32. That is, second molding member 31 includes the annular wall portion 310 projecting in the x negative direction beyond the x negative side end surface (300) of first molding member 30 and surrounding the group of covered segments A of covered wires 10*a*~10*e*. Thus, wall portion 310 defines adhesive receiving portion (in the form of depression 316 in this example) for receiving and retaining adhesive 32. Therefore, the sealing member can be formed readily by filling adhesive 32 in the depression 316 at least to a position on the x negative side of end surface 300 of first molding member 30. The sealing member thus formed by adhesive 32 closes a clearance formed between the insulating coverings of covered wires 10*a*~10*e* and first molding member 30 in the end surface 300, and envelope the insulating covering of each covered wire sealingly. Thus, second molding member 31 functions to facilitate the operation of applying the adhesive 32, and to seal the clearance and crack efficiently. Annular wall portion 310 of second molding member 31 forms the depression 316 like a reservoir for retaining and storing the adhesive 32 having a flowability at the time of application of adhesive 32. Therefore, the second molding member 31 promotes the operation of filling the adhesive 32 efficiently and facilitates the operation of forming the sealing member with adhesive 32. Even if a clearance is formed between the first and second molding members 30 and 31 (between the inside circumferential surface of engagement hole 314 of second molding member 31 and the outside circumferential surface of first molding member 30), the wall portion 310 of the illustrated example surrounds the outside circumference of first molding member 30, and the sealing member formed with adhesive 32 in the depression 316 includes an annular portion (rim portion) surrounding the first molding member 30 contiguously and sealingly and reaching the end surface 315 of second molding member 31. Therefore, the sealing member of adhesive 32 can seal the clearance between first and second molding members 30 and 31 efficiently and prevent water from entering through the clearance. In the illustrate example, the wall portion 310 extends around the first molding member so as to describe a closed figure shaped like a rectangle as viewed from the x negative side, and includes two laterally extending segments extending in the y axis direction and spaced from each other in the z axis direction, and two normally extending segments extending in the z axis direction between the laterally extending segments so as to form a rectangular closed figure. The wall thickness of the laterally extending segments is greater than the wall thickness of the normally extending segments, in the example shown in FIG. 7. However, it is possible to employ the wall portion 310 which is shaped like an oblong circle as shown in FIG. 14, and which has a uniform wall thickness over the entire circumference. In this case, it is possible to form the connection main portion 312 to have the outside circumference shaped like the oblong wall portion 310.

Second molding member 31 includes the connecting portion (or base portion) 311 formed on the x positive side of wall portion 310, and arranged to connect the wall portion 310 with first molding member 30 liquid-tightly. Therefore, connector 1 can be attached to an electric component (such as torque sensor TS) simply by attaching the connecting portion 311 of second molding member 31 to the electronic component (housing 2) without the need for attaching the first molding member 30 directly to the housing 2. Therefore, the structure including second molding member 31 eliminates the need for providing a special seal member between first molding member 30 and housing 2 (through hole 220), and hence facilitates the connecting operation of connector 1 (improves the connectivity). Specifically, second molding member 31 of the illustrated example includes the abutment surface 31*c* facing in the x positive direction, and abutting on the housing 2 (connector mount portion 22) when connector 1 is connected to torque sensor TS. This abutment (surface to surface contact) ensures the joint and sealing between connector 1 and housing 2 (connector mount portion 22), and prevent invasion of water into housing 2 through the through hole 220, to the uncovered segments B of covered wires 10 (and conductive member 11). Second molding member 31 is so formed that the parting plane α of the second mold 6 is located on the x negative side of abutment surface 31*c*. Therefore, the abutment surface 31*c* can be formed accurately in conformity with the shape (sealing plane) of second mold 6 without interference between the parting plane α and the abutment surface 31*c*, to the advantage of improvement of joining and sealing performance.

Second molding member 31 includes the engagement portion in the form of pins 31*a* and 31*b* on the x positive side end surface 31*c*. Pins 31*a* and 31*b* are adapted to engage with the electronic component (engagement holes or depressions of housing 2) when connector 1 is connected with the electronic component (torque sensor TS). The structure using the engagement of pins 31*a* and 31*b* with housing 2 functions to improve the positioning accuracy for positioning second molding member 31 (and first molding member 30) relative to the electronic component (housing 2). Therefore, the structure can improve the relative positioning accuracy of the terminals of connector 1 projecting inside housing 2 (conductive members 11*a*~11*e*) and the mating member (substrate 200) of the electronic component (torque sensor TS), hence improve the electric connectivity of connector 1, and improve the efficiency of operation of setting substrate 200 in housing 2 and connecting terminals 11*a*~11*e*. The number, shape and positions of pins 31*a* and 31*b* are not limited those of the illustrated example. Instead of the pins 31*a* and 31*b*, it is optional to employ various forms of the engagement portion for determine the position by engagement, such as a claw shaped structure (snap fit). Moreover, it possible to form one or more projections in housing 2, and to form, in connector 1, one or more depressions for engaging with the projections. Without using engagement or fitting, it is possible to achieve the positioning with one or more marks in housing 2, for indicating the position of connector 1.

Second molding member 31 includes the annular seal groove 318 formed in the abutment surface 31*c*, for receiving the seal member in the form of O ring. The O ring S installed in annular seal groove 318 functions to seal the clearance between housing 2 (connector mount portion 22) and connector 1 (abutment surface 31*c*). It is possible to omit the seal groove 318 and the seal member S, and to ensure the sealing performance with the abutment (surface to surface contact). However, the connecting structure employing the seal member (O ring) S can further improve the joining and sealing performance between connector 1 and the electronic component in the abutment surface 31*c*. Even if the abutment surface 31*c* is not entirely in contact with housing 2, the structure can ensure the desired sealing performance with the O ring S pressed tightly against housing 2. It is optional to form the seal groove in the electronic component instead of the seal groove 318 of second molding member 31. Moreover, it is optional to omit the seal groove. In the illustrated example of the first embodiment, the connector 1 (second molding member 31) is joined to the electronic component (connector mount portion 22 of housing 2) by fastening devices such as bolts b. Therefore, the O ring S is pressed in the x axis direction against the housing 2 by the axial forces of bolts b, and hence the sealing performance is improved. In order to reduce the size of connector 1, it is desirable to reduce the wall thickness (the dimension in the x axis direction) of second molding member 31 (the connecting portion 311). On the other hand, the formation of seal groove 318 decrease the wall thickness or dimension in the x axis direction of second molding member 31 (the connecting portion 311), and hence decreases the strength against the pressing force of the O ring, so that there is even a possibility of the second molding member 31 being bent at the position of seal groove 318. In the illustrated example of the first embodiment, the seal groove 318 is formed at such a position that the seal groove 318 overlaps the wall portion 310 as viewed from the x axis direction. Therefore, a decrease of the dimension in the x axis direction by the seal groove 318 is compensated for by the dimension in the x axis direction of wall portion 310 (complementing the decrease of strength caused by the formation of seal groove 318, with the wall portion 310). Accordingly, this arrangement prevent or restrain creep (deformation) of second molding member 31 (connecting portion 311). In the illustrated example, the seal groove 318 overlaps the wall portion 310, as viewed from the x axis direction (longitudinal direction of the covered wires 10), in the y axis direction and the z axis direction in which the wall portion 310 extends. There is no need for complete overlapping between seal groove 318 and wall portion 310 (one is included in the other as viewed from the x axis direction). The overlapping arrangement between seal groove 318 and wall portion 310 may be partial as viewed from the x axis direction, to an extent to compensate for a decrease of the strength (wall thickness) of second molding member 31 (preferably to such an extent that a half or more of one overlaps the other as viewed in the x axis direction).

Second molding member 31 of the illustrated example is formed by the insert molding process of molding in the state in which the first molding member 30 is placed, as an insert, in the second mold 6. The production method including the first molding step of molding first molding member 30 and the second molding step of molding second molding member 31 in the insert molding mode makes it easier to form the relatively complicated shape of connector 1 including wall portion 310 for holding adhesive 32 and connecting portion 311 for connection with an electronic component. This production method employing two molding steps for the first and second molding members 30 and 31 makes each of the molding operations simple and easier. Moreover, this production method makes it possible to form the first and second molding members 30 and 31 with two difference materials having different properties, and hence improves the moldability (formability). However, it is possible to employ a production method of forming the first and second molding members 30 and 31 by a single molding step. Furthermore, it is possible to form the shape of connecting portion 311 (wall portion 310) by another step (molding).

Wall portion 310 surrounds the first molding member 30 with a predetermined interspace or clearance extending around the first molding member 30 and spacing the wall portion 310 from the first molding member 30 (in the y axis direction and the z axis direction). This interspace acts to decrease the possibility of interference (contact) of second mold 6 with the insulating coverings of covered wires 10, and hence improves the moldability of second molding member 31. Second molding member 31 has the complicated shape including the annular wall portion 310, and the direction for extraction of second mold 6 is limited (mainly to the x axis direction). Moreover, from the x negative side end surface 300 of first molding member 30, the covered wires 10*a*~10*e* (covered portions A) extend in the x negative direction. Therefore, in the operation of removing the second mold 6, the covered wires 10*a*~10*e* may be contacted by the portion of second mold 6 forming the inner side of wall portion 310, and this contact or interference by the second mold 6 may break or remove the insulating coverings of covered wires 10*a*~10*e* (so as to bare the inner conductive wire). Therefore, the connecting structure is designed to facilitate extraction of the second mold 6 in the demolding operation, and to avoid interference (contact) between the second mold 6 and the insulating coverings of covered wires 10 as much as possible. Specifically, the second mold 6 is formed with the through hole 620 which extends in the x axis direction which is formed in the central region of second mold 6 surrounded by the portion forming the inner side of wall portion 610 and which receives therein the first molding member 30. At the time of the step of molding second molding member 31, the x negative side portion of first molding member 30 is fit in the x positive side portion of through hole 620, and the covered wires 10*a*~10*e* extend from the end surface 300 of first molding member 30 in the x negative direction through the through hole 320. At the time of demolding operation, the x positive and negative side parts 61 and 62 of second mold 6 are separated in the x direction and removed. The x negative side part 62 is removed to the x negative side, and the covered wires 10*a*~10*e* are moved only in the x axis direction relative to the part 62, so that this structure can restrain sliding contact between the part 62 (the inside surface of through hole 620) and the insulating coverings of covered wires 10*a*~10, and thereby facilitate the molding operation of second molding member 31. The structure including the interspace between the outside circumference of first molding member 30 and the inside surface of wall portion 310 of second molding member 31 is helpful in avoiding interference with the covered segments A, securing the wall thickness of second mold 6, and improving the moldability of second molding member 30 (wall portion 310). The interspace is extended entirely around the first molding member 30 to space the wall portion 310 from first molding member 30 (in the y axis direction and z axis direction), so that the above-mentioned effect is obtained for sure.

The outside surfaces of first molding member 30 defines the cavity in combination with the inside surfaces of second mold 6, and the material of second molding member 31 is filled in this cavity. Therefore, prevention of leakage of the filled material to the outside of the mold 6 is important between the outside surfaces of first molding member 30 and the inside surfaces of second mold 6. For example, it is undesirable to employ the structure in which the x negative side end surface (300) of first molding member 30 is located at the position in the x axis direction of the x negative side end surface 315 of connecting portion 311 of second molding member 31. In this structure, the seal length (the area of contact) is approximately equal to zero between the inside surface of second mold 6 for forming the connecting portion 311, and the outside surface of first molding member 30 (on the x negative side) for defining the cavity of the second mold 6, so that there is a possibility of leakage of the material therebetween. By contrast, in the structure according to the first embodiment, the x negative side end surface (300) of first molding member 30 projects in the x negative direction from the second molding member 31 (the x negative side end surface 315 of connecting portion 311 surrounded by wall portion 310). Therefore, the second molding member 31 can be molded in the state in which the x negative side portion of first molding member 30 is fit in the through hole 620 of second mold 6. In this case, it is possible to obtain a seal surface formed between first molding member 30 and second molding member 31, to an extent corresponding to the length of projection of first molding member 30 (the distance in the x axis direction of the above-mentioned fitting portion). This structure can restrain leakage of the material during the molding operation with the second mold 6 and improve the moldability. The projection of the x negative side end surface 300 of first molding member 30 in the x negative direction from the x negative side end surface 315 of connecting portion 311 surrounded by wall portion 310 means the existence of the interspace between the wall portion 310 and the first molding member 30. The structure having the interspace can restrain damage of covered wires 10*a*~10*e* due to interference of second mold 6, and improve the moldability.

First molding member 30 is formed with at least one rib 301 at the position surrounded by second molding member 31. The rib 301 is small in heat capacity as compared to the other portions of first molding member 30, and apt to melt at high temperatures. Therefore, at the time of insert molding with the second mold 6, the rib 301 first becomes soft or molten, and thereby improves the joining property between first and second molding members 30 and 31. Specifically, the rib 301 is located at the position adjacent to the gate 60 through which the molten material is poured. Therefore, when the high temperature molten second resin material is poured into second mold 6 through the gate 30, the rib 301 first touches the molten material, and melts promptly, to improve the joining property between first and second molding members.

[Effects of First Embodiment] The connecting structure including the connector 1 and the production method according to the first embodiment can provide following effects.

(1) A connecting structure is a structure (including a connector 1) to connect electronic components (such as torque sensor TS and control unit ECU) electrically. The connecting structure comprises a plurality of conducting lines (10*a*~10*e*, 11*a*~11*e*), a (first) molding member (30), a holding member (31) (second molding member), and a sealing member made of an adhesive (32). Each of the conducting lines (10*a*~10*e*, 11*a*~11*e*) includes a covered segment (A) having an insulating covering to cover a conductor and an uncovered segment (B) including the conductor bared with no insulating covering. The (first) molding member (30) is a member of a material such as a resin material fixing positions of the conducting lines relative to one another (by becoming solid or hard, or coagulating after the molding operation), and enclosing boundary portions of the covered segments and the uncovered segments of the conducting lines so that the uncovered segments (B) project in a first direction (x positive direction) from a first side end surface (on the x positive side) of the molding member (30) and the covered segments (A) project in a second direction (x negative direction) from a second side end surface (300)(on the x negative side). The holding member (31) is formed on the molding member (30) by a second step different from a first step of forming the molding member (30). The holding member (31) include an annular wall portion (310) projecting in the second direction (x negative direction) beyond the second side end surface (300) of the molding member (30) and surrounding the covered segments (A) of the conducting lines, and a base portion or connecting portion (311) formed on the first side (x positive side) of the wall portion (310) and arranged to connect the wall portion (310) and the molding member (30) liquid-tightly. The sealing member of the adhesive (32) is formed in the holding member (31) (in depression 316), and arranged to adhere to the outside circumference of each of the covered segments (A) of the conducting lines projecting from the second side end surface. The covered segments (A) of the conducting lines projecting from the second side end surface (300) of the molding member (30) are buried at least partly in the adhesive (32). The thus-constructed connecting structure secures the sealing performance (waterproofness) of the conducting lines and simplifies the construction of the connecting structure.

(2) The (first) molding member (30) is made of a material nonadherent to the insulating material. Therefore, it is possible to improve the efficiency of the molding operation of the (first) molding member (30).

(3) The holding member (second molding member 31) is formed by the insert molding process in the state in which the first molding member (30) is set in a mold (second mold 6), and so shaped that the x negative side end surface (300) of the first molding member (30) projects from the holding member (31) (from the end surface 315 of the connecting portion 311). Therefore, it is possible to improve the efficiency of the operation of molding the first molding member (30) and the operation of molding the holding member (second molding member 31).

(4) The annular wall portion (310) is spaced at a predetermined distance from the outside circumferential surface of the first molding member (30) (in the y axis direction and the z axis direction). Therefore, the second mold (6) for forming the holding member (31) can be shaped to lower the possibility of interference with the insulating coverings of the covered wires (10*a*~10*e*), so that the efficiency of the molding operation for the second molding member (31) can be improved.

(5) The annular wall portion (310) is spaced from the outside circumferential surface of the first molding member (30) so that an annular interspace spacing the annular wall portion (radially) from the first molding member extends entirely around the first molding member (30). Therefore, it is possible to improve the effect of the above-mentioned feature (4).

(6) The first molding member (30) includes holes (30*a*~30*d*) formed by pins (5*a*~5*d*) used, in the molding operation to form the first molding member (30), for regulating the relative positions of the covered wires (10*a*~10*d*) to one another. Therefore, the structure can improve the relative position accuracy of the covered wires (10*a*~10*e*) at the time of molding the first molding member (30).

(7) The holding member (second molding member 31) is formed by the insert molding process using the first molding member (30) as an insert set in a mold (second mold 6) for forming the holding member (31), and the first molding member (30) is formed with at least one projection (rib 301) in a portion surrounded by and buried in the holding member (31). This structure can improve the property of the joint between the first molding member and the holding member.

(8) The projection (rib 301) is provided at a position adjacent to a feed opening or sprue (gate 60) of the mold (second mold 6) of the holding member (31) for introducing a molten material into the mold. This structure can improve the effect of the above-mentioned feature (7).

(9) The holding member (second molding member 31) includes an abutment surface (31*c*) formed on the first side (x positive side) to face in the first direction (x positive direction) and arranged to abut on an electronic component (TS)(housing 2) when the connector is connected with the electronic component. Moreover, the holding member (31) is formed by insert molding with a mold (6) having a parting plane (α) which is located on the second side (x negative side) of the abutment surface (31*c*). Therefore, it is possible to improve the joint properties (sealing performance) of the abutment surface (31*c*) with the electronic component.

(10) The holding member (second molding member 31) includes an engagement portion (pins 31*a* and 31*b*) which is formed in the uncovered side end surface (x positive side end surface) and arranged to engage with a first electronic component when connected with the first electronic component (torque sensor TS). This structure can improve the electrical connectability.

(11) The holding member (second molding member 31) includes a seal groove (318) formed in the abutment surface (31*c*) facing in the first (x positive) direction to abut again a first electronic component (torque sensor TS). The seal groove (318) is adapted to receive a seal member (O ring S). The seal groove (318) is so formed as to overlap the position of the wall portion (310) in the direction (y-z plane) perpendicular to the longitudinal direction of covered wires (10*a*~10*e*). This structure can improve the sealing performance of the connector, and make it possible to reduce the size of the connector and restrain a decrease of the strength of the connector.

(12) A production method for forming a connecting structure (including a connector 1) to connect electronic components (TS, ECU) electrically, comprises first, second and third steps. The first step is a step of filling a first material such as a first resin material into a first mold (4) and thereby forming a molding member (30) of the first (resin) material holding a plurality of conducting lines each including a covered segment including a wire conductor covered with an insulating covering and an uncovered segment in which the wire conductor is bared, and enclosing a boundary portion between the covered segment (A) and the uncovered segment (B) of each of the conducting lines so that the uncovered segments (B) (bared wire conductor or bared lead conductor) project in a first direction (x positive direction) from a first end (x positive side) of the molding member and the covered segments (A) project in a second direction (x negative direction) from a second end (300) (x negative side) of the molding member. The second step is a step of filling a second material such as a second resin material into a second mold (6) with the molding member (30) set in the second mold (6), and thereby forming a holding member (31) (second molding member) of the second (resin) material fitting over the molding member (30) liquid-tightly, and defining a receiving portion (316). The third step is a step of forming a sealing member (32) of an adhesive (32) in the receiving portion (316) defined by the holding member so that the adhesive adheres to each of the covered segments (A) of the conducting lines projecting from the second end (300) of the molding member (30). Therefore, the production method can fix the relative positions of conducting lines readily, facilitate the first molding step of forming the molding member (30) by forming the holding member by another step, prevent ingress of water by filing the adhesive in the receiving portion defined by the holding member, and facilitate the operation of forming the sealing member (32) by filling the adhesive in the receiving portion.

(13) The second molding member (holding member) (31) is so formed that the second end (300) of the first molding member (30) projects in the second direction (x negative direction) from a connecting portion or base portion (311) (315) of the second molding member (31). This structure facilitates the insert molding process with the second mold (6) since the projected portion of the first molding member can serve as a seal portion for the insert in the second mold (6). Moreover, this structure can reduce the possibility of injury of the covered wires by the second mold (6).

(14) Lead conductors (11*a*~11*e*) are connected, respectively, with the covered wires (10*a*~10*e*). The molding operation in the first step is performed in the state in which the lead conductors are connected together with a connecting portion (11B). This structure can improve the relative position accuracy of the lead conductors (11*a*~11*e*).

(15) The connecting portion (11B) is cut off after the first step, to separate the lead conductors 11*a*~11*e*. This structure can improve the relative position accuracy of the lead conductors (11*a*~11*e*).

Second Embodiment

Figure 15:
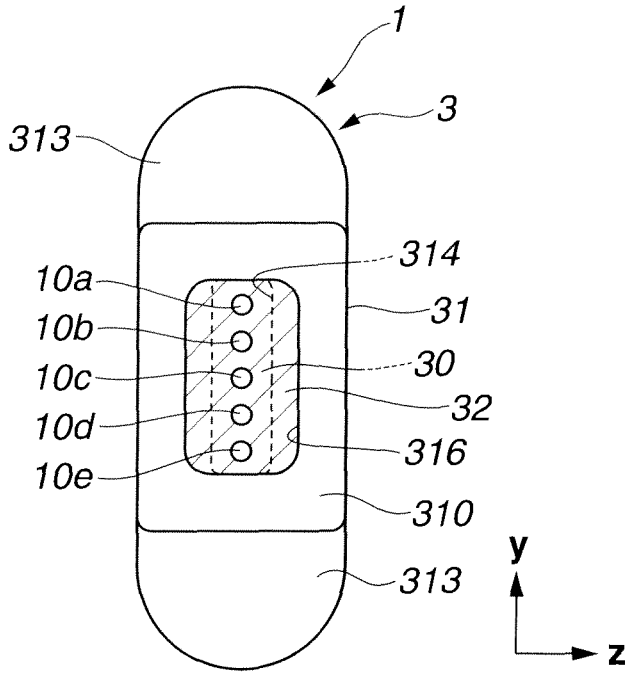
FIG. 15 is a front view showing the connector 1 according to a second embodiment, as viewed from the x negative side or from the signal line L21 side.

A connector 1 according to a second embodiment is different from the connector of the first embodiment in the shape of wall portion 310 (depression 316) of second molding member 31. FIG. 15 is a front view similar to FIG. 7 but showing the connector 1 according to the second embodiment from the x negative side. In FIG. 15, the bolt through holes 319 are omitted. As shown in FIG. 15, the annular wall portion 310 is shaped to lie away from the outside circumference of first molding member 30 in a predetermined first region (on the z positive side and the z negative side, in this example), and to lie closer to, or adjacent to, the outside circumference of first molding member 30 in a predetermined second region (on the y positive side and on the y negative side, in this example). The wall portion 310 includes two laterally extending segments extending in the y axis direction and spaced from each other in the z axis direction, and two normally extending segments extending in the z axis direction between the laterally extending segments so as to form a rectangular closed shape. The wall thickness of the normally extending segments is increased on the inner side toward the outside circumference of the first molding member 30. As viewed from the x axis direction, the inside surface of each of the normally extending segments extending in the z axis direction is adjacent to the outside circumference of the first molding member 30 with no or little spacing.

Therefore, in the depression 316 shown in FIG. 15, the adhesive 32 is not filled between the first molding member 30 and each of the normally extending segments on the y positive side and y negative side. In this case, it is possible to reduce the required amount of adhesive 32, as compared to the first embodiment. In the first embodiment, the interspace to be filled with the adhesive is formed all around the first molding member 30 in the depression 316 surrounded by the wall portion 310. However, it is optional to eliminate part of the interspace between the wall portion 310 and the first molding member 30, and leaving the remaining part of the interspace to prevent interference between the insulating coverings of covered wires 10*a*~10*e* and the second mold 6. In the second embodiment, the interspace is formed between the first molding member 30 and each of the laterally extending segments extending along the row of covered wires 10*a*~10*e* on the z positive side and z negative side, and having greater influence on the interference with the second mold 6. Accordingly, the structure of the second embodiment can prevent interference effectively, and reduce the production cost by reducing the amount of the adhesive.

Third Embodiment

Figure 16:
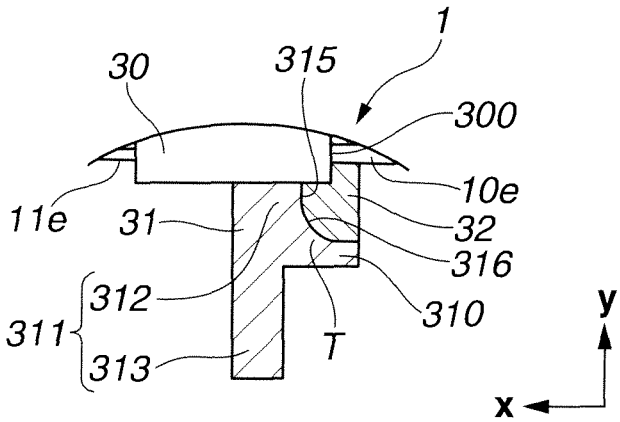
FIG. 16 is a partial sectional view showing the connector according to a third embodiment.

A connector 1 according to a third embodiment is different from the connector of the first embodiment in the shape of wall portion 310 (depression 316) of second molding member 31. FIG. 16 is a partial sectional view similar to FIG. 6 but showing the connector 1 according to the third embodiment (showing only the y negative side). The seal groove 318 and pins 31*b* are omitted. As shown in FIG. 16, the inside circumferential surface of wall portion 310 of second molding member 31 is inclined or curved so that the inside circumferential surface of wall portion 310 becomes closer to the first molding member 30 on the inner side gradually in the direction from the projecting end of wall portion 310 on the x negative side, toward the bottom (315) on the x positive side. In other word, the second molding member 31 includes a tapered portion T in which the dimension of the y axis direction (the inside diameter or radius) of the inside circumferential surface of depression 316 for retaining the adhesive 31 is decreased gradually toward the bottom (315) of the depression 316. Thus, in the illustrated example of this embodiment, the recessed corner or reentrant corner formed between the bottom surface 315 and the inside circumferential surface of wall portion 310 is rounded or inclined. In the other respects, the third embodiment is substantially identical to the first embodiment so that repetitive explanation is omitted. The tapered portion T acts to reduce the amount of adhesive 31, and to guide the adhesive 32 to be filled into a recessed portion.

Fourth Embodiment

Figure 17:
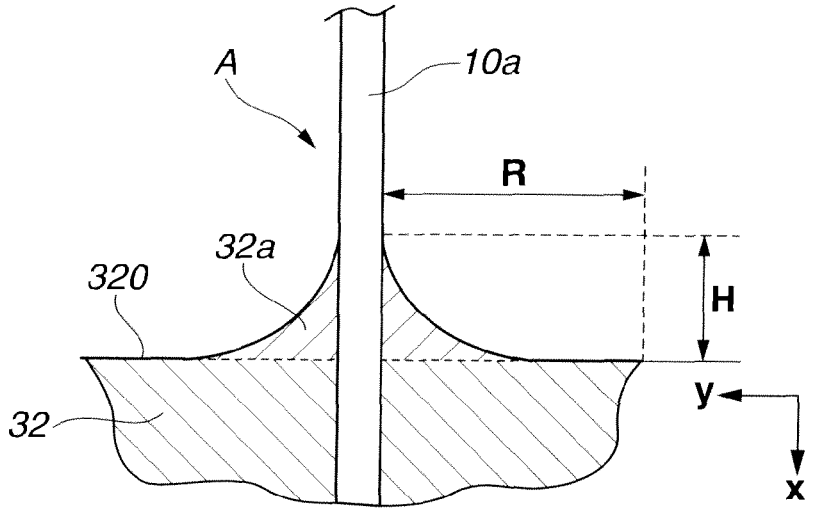
FIG. 17 is a partial sectional view showing the connector according to a fourth embodiment, around one of the covered wires.

A connector 1 according to a fourth embodiment is different from the connector 1 of the first embodiment in the shape of the sealing member of the adhesive 32. FIG. 17 is a partial sectional view similar to FIG. 6, but showing the connector 1 of the fourth embodiment only around the covered wire 10*a*. The other covered wires 10*b*~10*e* are arranged in the same manner, so that repetitive explanation is omitted. As shown in FIG. 17, adhesive 32 forms a fillet portion 32*a* in a boundary portion with the covered wire 10*a*. Adhesive 32 filled in the depression 312 forms the sealing member of adhesive 32 having a surface 320 facing in the x negative direction. The fillet portion 32*a* projects in the x negative direction from the adhesive surface 320 along covered wire 10*a*, and covers the outside circumference of covered wire 10*a*. Fillet portion 32*a* is formed by pulling the adhesive 32 by a surface tension of the adhesive in the x negative direction from the adhesive surface 320. It is possible to select, as the adhesive 32, an adhesive generating an appropriate surface tension when the adhesive is flowable at the time of filling the adhesive in depression 316. The fillet portion 32*a* is tapered in the x negative direction along covered wire 10*a*. In this example, the outside radius of fillet portion 32*a* (about the covered wire 10*a* in the y-z plane) becomes gradually smaller in the direction from the base portion on the x positive side toward the top end on the x negative side. In this example, the outside radius R of fillet portion 32*a* in the x positive side end (surface 320) is greater than a length H of fillet portion 32*a* in the longitudinal direction (x axis direction) of the covered wire 10. In the other respect, the fourth embodiment is substantially identical to the first embodiment, and repetitive explanation is omitted.

The fillet portion 32*a* pulled up from end surface 320 in the x negative direction functions to increase the seal length (in the longitudinal direction of the covered wire 10) between the adhesive 32 and the covered wire 10 as compared to the first embodiment. Accordingly, it is possible to lower the end surface 320 of the adhesive 32 toward the bottom (315, 300) of the depression in the x positive direction so as to decrease the depth of adhesive 32 and to decrease the amount of adhesive 32 without decreasing the seal length with the additional seal length added by the fillet portion 32*a* of each covered wire. The tapered shape of fillet portion 32*a* as shown in FIG.

17 can mitigate the stress concentration at the boundary between adhesive 32 and each covered wire 10*a*~10*e*, hence prevent cracks from being produced in the adhesive by bending of covered wires 10*a*~10*e*, and improve the waterproofness of connector 1. The tapered shape of fillet portion 32*a* may be formed by a curved surface or curved surfaces as shown in FIG. 17 or may be formed by inclined flat surfaces. In the example of FIG. 17, the fillet portion 32*a* spreads broad at a foot of the mountain-shaped fillet portion 32*a* so that the outside radius R is greater than the height H. Therefore, it is possible to increase the rigidity of fillet portion 32*a* and prevent cracks of fillet portion 32*a*.

Thus, the adhesive 32 includes the fillet portion 32*a* climbing by clinging and sheathing each covered wire in the x negative direction to the height H from the adhesive surface 320. This structure can improve the waterproofness. Furthermore, the fillet portion 32*a* has the tapered shape or mountain-like shape tapering toward the top of fillet portion 32*a* in the x negative direction, and spreading wider toward the base (320) in the x positive direction. This structure can further improve the waterproofness.

Fifth Embodiment

Figure 18:
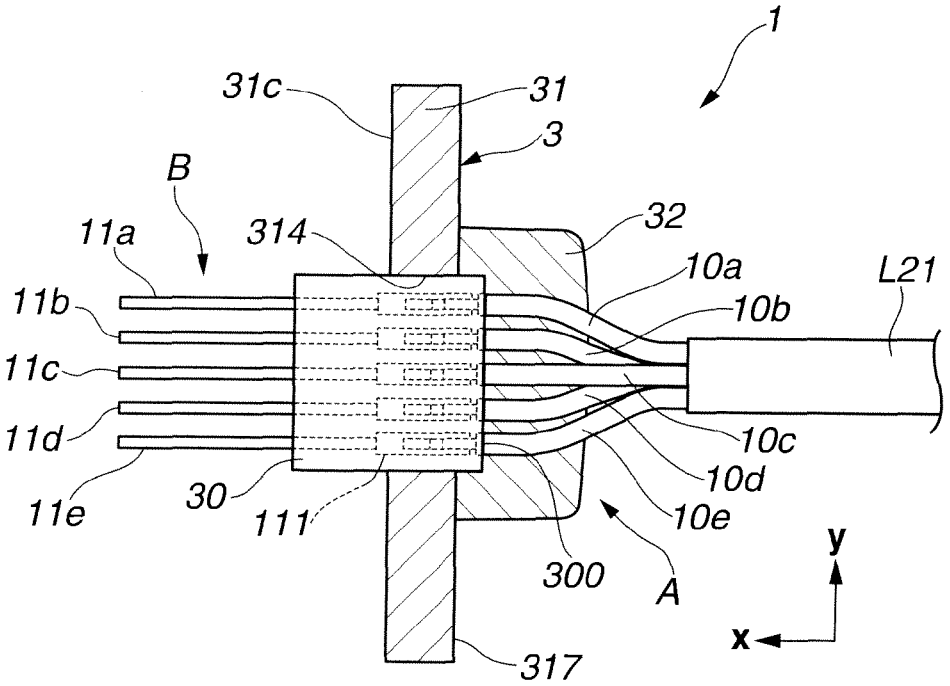
FIG. 18 is a partial sectional view showing the connector according to a fifth embodiment.
Figure 19:
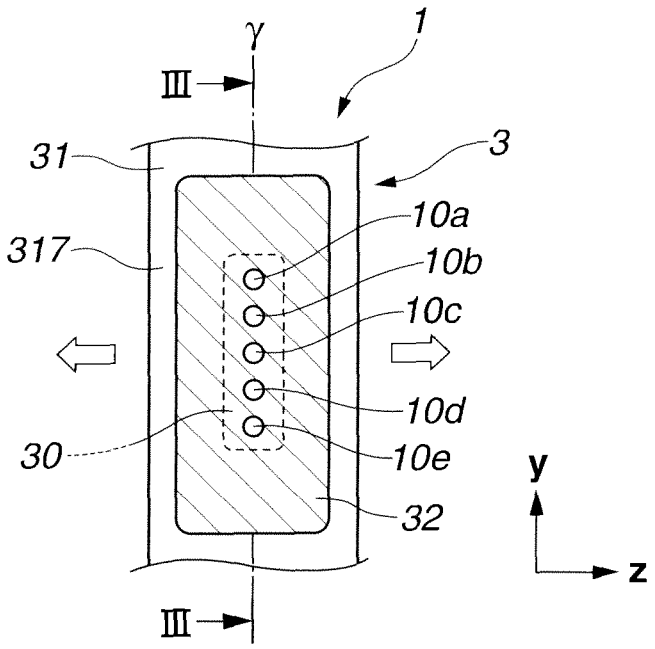
FIG. 19 is a front view showing the connector 1 according to the fifth embodiment, as viewed from the x negative side or from the signal line L21 side, and showing a parting plane γ of a mold for a sealing member 32.

A connector 1 according to a fifth embodiment is different from that of the first embodiment in the shapes of second molding member 31 and adhesive 32. FIG. 18 is a partial sectional view similar to FIG. 6, but showing the connector 1 according to the fifth embodiment (corresponding substantially to a sectional view taken across a line shown in FIG. 19). FIG. 19 is a front view similar to FIG. 7, but showing the connector 1 of the fifth embodiment as viewed from the x negative side. FIG. 19 shows only part of connector 1. In FIG. 19, seal groove 318 and pins 31*b* are omitted. As shown in FIG. 18, the second molding member 31 is a member shaped like a flat plate in which the wall portion 310 is eliminated, and the connection main portion 312 is modified. Second molding member 31 includes the engagement hole 314 receiving and holding the first molding member 30, and the abutment surface 31*c* adapted to be joined to housing 2. Second molding member 31 shown in FIG. 18 includes an x negative side end surface 317 opposite to the abutment surface 31*c*. The sealing member 32 is provided on the x negative side surface 317 of second molding member 31.

The sealing member 32 is made of the adhesive. Sealing member 32 covers the first molding member 30 (and the engagement hole 314) as viewed in the x axis direction. The end portion including the end surface 300 of first molding member 30 projects in the x negative direction from second molding member 31, and the sealing member 32 projects beyond the end surface 300 of first molding member 30 in the x negative direction, and encloses the covered segment of each of covered wires 10*a*~10*e*. Sealing member 32 is appressed to the x negative side (300) of first molding member 30 and adheres to the insulating covering of each of covered wires 10*a*~10*e*. In the illustrated example, the end portion of first molding member 30, including the end surface 300 and projecting in the x negative direction from second molding member 31 is buried in the sealing member 32 and each of the covered segments A of covered wires 10*a*~10*e* is buried partly in the sealing member 32, and projected from the x negative side of the sealing member 32. Sealing member 32 is formed by a molding process of filling the adhesive in a (third) mold in which the first and second molding members 30 and 31 are placed. The sealing member 32 is formed by filling the adhesive which has a flowability at least at the time of operating of filling the adhesive in the mold, and removing the mold after the adhesive is coagulated and hardened. As the material of the adhesive, it is possible to select an adhesive enabling or facilitating a molding process forming the sealing member 32. As shown in FIG. 19, the mold for forming the sealing member 32 is arranged to clamp the covered wires 10*a*~10*e* from both sides in the z direction (from the z positive side and the z negative side), and the mold is divided as shown by arrows along a parting plane γ (in the z positive direction and the z negative direction). The parting plane γ is parallel to the x axis direction (and perpendicular to the z axis direction). In the other respects, the fifth embodiment is substantially identical to the first embodiment, so that repetitive explanation is omitted.

The covered wires 10*a*~10*e* are held firmly or gripped by first molding member 30 so that the relative positions of covered wires 10*a*~10*e* relative to one another are fixed. Sealing member 32 of adhesive is attached firmly to the x negative side end surface 300 of first molding member 30, and encloses the insulating covering of each of covered wires 10*a*~10*e* adherently. Therefore, the structure including the sealing member 32 shown in FIGS. 18 and 19 can prevent ingress of water through clearance between first to molding member 30 and the outside circumference of each covered wire 10*a*~10*e* to the uncovered segments B. The structure can improve the efficiency of the production process by employing the molding process using a mold to form the sealing member 32. The second molding member 31 does not require the wall portion 310 and requires only the connecting portion 311 of the simplified form similar to a mere flat plate. Therefore, the structure can improve the moldability of second molding member 31. Furthermore, by using the third mold for the sealing member 32 in addition to the molds for the first and second molding members 30 and 31, it is possible to facilitate the molding processes for first and second molding members 30 and 31. Moreover, it is possible to reduce the number of required parts. In other words, in the fifth embodiment, the first and second molding members 30 and 31 are two distinct members. However, since the entire molding member formed by first and second molding members 30 and 31 has a simple structure, it is possible to form the first and second molding members 30 and 31 as a single molding member of the same resin material which can formed by a single molding operation (before the operation of forming the sealing member 32), to the advantage of improvement of the production process. In this case, there is no need for a sealing operation for sealing a clearance between first and second molding members 30 and 31 (the inside circumference of engagement hole 314 and the outside circumference of first molding member 30). Therefore, the sealing member 32 is required to cover only the x negative side end surface 300, so that it is possible to reduce the amount of the adhesive.

The mold for forming sealing member 32 is removed in the radial direction of each covered wire 10*a*~10*e* (z axis direction), as shown in FIG. 19. Accordingly, it is possible to reduce the possibility of sliding contact between the mold and covered wires 10*a*~10*e* causing injury of covered wires 10*a*~10*e*, and thereby to improve the moldability of sealing member 32, as compared to the mold releasing operation in the longitudinal direction of covered wires 10*a*~10*e* (x axis direction). It is optional to eliminate the second molding member 31. For example, it is possible to set and fit the first molding member 30 in the through hole 220 of housing 2, and form the sealing member 32 in this state by sealing the clearance between the first molding member 30 and the through hole 220, and by enclosing the insulating covering of each of covered wires 10*a*~10*e*.

According to the fifth embodiment, a connecting structure (including a connector 1) to connect electronic components (TS, ECU) electrically, comprises a plurality of conducting lines (10*a*~10*e*, 11*a*~11*e*), a molding unit, and a sealing member (32). Each of the conducting lines (10*a*~10*e*, 11*a*~11*e*) includes a covered segment (A) including a wire conductor covered with an insulating covering and an uncovered segment (B) including the wire conductor in an uncovered state having no insulating covering. The molding unit (3, 30, 31) of a resin material encloses a boundary portion between the covered segment and the uncovered segment of each of the conducting lines so that the uncovered segments project in a first direction from a first end (x positive side) of the molding unit and the covered segments project in a second direction from a second end (300) (x negative side) of the molding unit, and thereby holds the conducting lines to fix positions of the conducting lines relative to one another. The sealing member is made of a material such as an adhesive contacting with the second end (300) of the molding unit, and adhering to each of the covered segments of the conducting lines projecting from the second end (300) of the molding unit. In the illustrated example, the sealing member (32) is formed by filling the adhesive in a (third) mold in which the molding unit (3, 30, 31) is placed. The adhesive is flowable at least at the time of the operation of filling the adhesive in the (third) mold, and the mold is removed after the adhesive becomes hard. The structure of the fifth embodiment can ensure the sealing performance (waterproofness) of the covered wires, simplifies the structure of connector and improve the connector structure.

In the illustrated example of the fifth embodiment, the mold for forming the sealing member (32) is split mold having a parting plane (γ) extending in the longitudinal direction of the covered wires (10*a*~10*e*) (the x axis direction), and extends in the lateral direction (the y axis direction)(for example, in such a manner as to divide the row of covered wires (10*a*~10*e*) into left and right halves so as to cut each of the covered wires into semicircular halves). This structure can improve the moldability of connector 1.

According to one of various possible interpretations of the illustrated embodiments of the present invention, a connecting structure (which may include a connector (1)) to connect electronic components electrically through a plurality of conducting lines (10*a*~10*e*, 11*a*~11*e*) each including a covered segment (A) including a wire conductor covered with an insulating covering and an uncovered segment (B) including the wire conductor in an uncovered state having no insulating covering, comprises a molding unit and a sealing member (32). The molding unit (3, 30, 31) is made of a (resin) material and arranged to enclose a boundary portion between the covered segment and the uncovered segment of each of the conducting lines so that the uncovered segments project in a first direction from a first end (x positive side) of the molding unit and the covered segments project in a second direction from a second end (300) (x negative side) of the molding unit, and thereby holding the conducting lines to fix positions of the conducting lines relative to one another. The sealing member (32) of an adhesive adheres to the second end of the molding unit and adheres to each of the covered segments of the conducting lines projecting from the second end of the molding member. In the illustrated embodiments, the sealing member includes a cover portion adhering to the second end (300) of the molding unit (3, 30, 31) and enclosing the covered segments (A) of the conducting lines (10*a*~10*e*, 11*a*~11*e*) projecting from the second end of the molding unit so that each of the covered segments of the conducting lines includes a buried portion buried in the sealing member and a non-buried portion projecting from the sealing member in the second direction (x negative direction) and the second end of the molding unit is buried in the sealing member, and a rim portion projecting in the first direction (x positive direction) from the cover portion of the sealing member and fitting over the molding unit. In the illustrated examples of the illustrated embodiments, the molding unit (3, 30, 31) includes an inner portion (30) including the first and second ends of the molding unit, enclosing the boundary portion between the covered segment and the uncovered segment of each of the conducting lines so that the uncovered segments project in the first direction from the first end of the inner portion of the molding unit, and the covered segments project in the second direction from the second end of the inner portion of the molding unit, and thereby holding the conducting lines to fix positions of the conducting lines relative to one another; and the molding unit further includes a base portion (31, 311) fitting over the inner portion (30), the first end of the inner portion (30) projects in the first direction from the base portion and the second end of the inner portion projects from the base portion in the second direction.

According to one of various possible interpretations of the illustrated embodiments of the present invention, a production method of producing a connecting structure to connect electronic components electrically through a plurality of conducting lines each including a covered segment including a wire conductor covered with an insulating covering and an uncovered segment including the wire conductor in an uncovered state having no insulating covering, comprises a molding step of forming a molding unit (3, 30, 31) and a sealing step of forming a sealing member (32). The molding step includes an operation of filling a (resin) material into a mold and thereby forming a molding unit (3, 30, 31) enclosing a boundary portion between the covered segment and the uncovered segment of each of the conducting lines so that the uncovered segments project in a first direction from a first end of the molding unit and the covered segments project in a second direction from a second end of the molding unit, and thereby holding the conducting lines to fix positions of the conducting lines relative to one another. The sealing step includes an operation of forming the sealing member (32) of an adhesive adhering to the second end of the molding unit and adhering to each of the covered segments of the conducting lines projecting from the second end of the molding unit. The sealing step may include an operation of filling the adhesive in a mold for forming the sealing member; and the molding unit formed by the molding step includes a base portion (311) fitting over the molding member liquid-tightly, and including a wall surface (317) facing in the second direction (x negative direction) and defining a receiving portion for receiving the adhesive with the mold for forming the sealing member of the adhesive.

This application is based on a prior Japanese Patent Application No. 2010-273253 filed on Dec. 8, 2010. The entire contents of this Japanese Patent Application are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A connecting structure to connect electronic components electrically, the connecting structure comprising:

a plurality of conducting lines, each of the conducting lines including a covered segment including a wire conductor covered with an insulating covering and an uncovered segment including the wire conductor in an uncovered state having no insulating covering;

a molding member of a resin material enclosing a boundary portion between the covered segment and the uncovered segment of each of the conducting lines so that the uncovered segments project in a first direction from a first end of the molding member and the covered segments project in a second direction from a second end of the molding member, and thereby holding the conducting lines to fix positions relative to one another;

a holding member including a base portion fitting over the molding member liquid-tightly, and a wall portion projecting from the base portion in the second direction beyond the second end of the molding member and surrounding the covered segments of the conducting lines projecting from the second end of the molding member; and an adhesive provided in the holding member, the adhesive adhering to each of the covered segments of the conducting lines projecting from the second end of the molding member, wherein the base portion of the holding member comprises:

an engagement hole in which the molding member is fitted, an abutment surface facing in the first direction around the molding member, an inner end surface facing in the second direction around the molding member, and defining a bottom of a depression surrounded by the wall portion and depressed in the first direction to retain the adhesive; and wherein the first end the molding member projects in the first direction from the abutment surface of the holding member, and the second end of the molding member projects in the second direction from the inner end surface of the base portion.

2. The connecting structure as claimed in claim 1, wherein the connecting structure is an integral molding unit of a connector to connect the electronic components electrically, and wherein the molding member and the holding member are formed directly and integrally over the molding member as integral parts of the integral molding unit.

3. The connecting structure as claimed in claim 1, wherein the molding member includes a first end portion projecting in the first direction from a first surface of the base portion of the holding member, and a second end portion projecting in the second direction from a second surface of the base portion of the holding member; and wherein the wall portion of the holding member surrounds the second end portion of the molding member with an interspace formed between the second end portion of the molding member and the wall portion of the holding member.

4. The connecting structure as claimed in claim 3, wherein a sealing member is made of the adhesive provided in the holding member, wherein the sealing member comprises a cover portion adhering to the second end of the molding member and enclosing the covered segments of the conducting lines projecting from the second end of the molding member so that the second end of the molding member is buried in the adhesive, wherein each of the covered segments of the conducting lines includes a buried portion buried in the adhesive and a non-buried portion projecting from the sealing member in the second direction, wherein the sealing member further comprises a rim portion projecting in the first direction from the cover portion and fitting over the molding member, and wherein the cover portion and the rim portion of the sealing member are fit in the wall portion of the holding member.

5. The connecting structure as claimed in claim 1, wherein the abutment surface of the holding member is adapted to be joined to a connector mount surface of a housing of one of the electronic components, and wherein the abutment surface is formed with a seal groove receiving a seal to be pressed between the abutment surface and the connector mount surface.

6. The connecting structure as claimed in claim 1, wherein each of the conducting lines comprises a wire as the wire conductor with a covered portion forming the covered segment and an uncovered portion in which the wire is bared, and a lead conductor connected with the uncovered portion of the wire so as to form the uncovered segment;

wherein the lead conductors project from the first end of the molding member in the first direction; and wherein the uncovered portions of the covered wires are buried in the molding member.

* * * * *